US005359846A

United States Patent [19]

Miyamoto et al.

[11] Patent Number: 5,359,846

[45] Date of Patent: Nov. 1, 1994

[54] SPINNING APPARATUS OF ROTOR TYPE OPEN-END SPINNING UNIT AND ROTOR DRIVING METHOD

[75] Inventors: Noriaki Miyamoto; Masashi Kaneko; Kenji Ito; Yasuyuki Kawai, all of Kariya, Japan

[73] Assignee: Kabushiki Kaisha Toyoda Jidoshokki Seisakusho, Kariya, Japan

[21] Appl. No.: 921,312

[22] Filed: Jul. 28, 1992

[30] Foreign Application Priority Data

Jul. 29, 1991 [JP] Japan ..... 3-189033
Dec. 26, 1991 [JP] Japan ..... 3-345131

[51] Int. Cl.[5] ..... D01H 4/40; D01H 4/50

[52] U.S. Cl. ..... 57/417; 57/404; 57/414

[58] Field of Search ..... 57/400, 401, 404, 408, 57/407, 411, 413, 415, 417

[56] References Cited

U.S. PATENT DOCUMENTS

| | | | |
|---|---|---|---|
| 3,336,742 | 8/1967 | Stary et al. | 57/417 |
| 3,779,620 | 12/1973 | Stahlecker | 308/203 |
| 3,908,349 | 9/1975 | Urifu et al. | 57/415 X |
| 4,044,537 | 8/1977 | Negishi et al. | 57/417 X |
| 4,471,608 | 9/1984 | Kawabata et al. | 57/411 X |
| 4,510,745 | 4/1985 | Kawabata et al. | 57/415 |
| 4,593,522 | 6/1986 | Ishizuka et al. | 57/404 X |
| 4,625,506 | 12/1986 | Beckers | 57/404 X |
| 4,731,987 | 3/1988 | Jaros et al. | 57/415 |

FOREIGN PATENT DOCUMENTS

| | | |
|---|---|---|
| 2552955 | 8/1976 | Germany . |
| 51-64034 | 3/1976 | Japan . |
| 57-56528 | 4/1982 | Japan . |

*Primary Examiner*—Daniel P. Stodola
*Assistant Examiner*—William Stryjewski
*Attorney, Agent, or Firm*—Brook Haidt Haffner & Delahunty

[57] ABSTRACT

Opened fibers are supplied into a rotor in high rotation, and a fiber bundle collected at a fiber-collecting section of the rotor is drawn as yarn from a yarn drawing passage provided on the open side of the rotor. A rotary assembly which is actively driven separately from the rotor is provided coaxially in the rotor. The rotary assembly has at least part thereof facing the vicinity of the fiber-collecting section and another part shaped to face a first end of the yarn drawing passage. The rotary assembly is provided with a yarn passage for guiding a fiber bundle to a position opposite the yarn drawing passage from the vicinity of the fiber-collecting section. A twist propagation preventing portion is provided in that end of the yarn passage that lies on the fiber-collecting section side. The rotation of the fiber bundle is suppressed by the twist propagation preventing portion, stopping the twisting. At the time the fiber bundle is twisted, tension is applied to the fibers so that the fibers are twisted while being stretched.

16 Claims, 15 Drawing Sheets

SPINNING APPARATUS OF ROTOR TYPE OPEN-END SPINNING UNIT AND ROTOR DRIVING METHOD

BACKGROUND OF THE INVENTION

1. Technical Field

The present invention relates to a rotor type open-end spinning unit and a rotor driving method therefor.

2. Related Background Art

Open-end spinning units which do not require a roving process by a roving frame are popular due to the improved productivity and possible cost reduction concerning the facility investment or the like. Of the open-end spinning units, a rotor type is the oldest and has been proved reliable.

In this rotor type open-end spinning unit, a supplied sliver is opened by a combing roller and, at the same time, foreign matter is expelled. The opened fibers are supplied into a rotor in high speed rotation by an air-stream created in the fiber transport channel due to the negative pressure in the rotor, and are collected at a fiber-collecting section, a portion of the rotor with the largest inner diameter. The fiber bundle at the fiber-collecting section is drawn out by a draw roller from a yarn drawing passage, provided on the open side of the rotor on the same axial line as the rotor, while being twisted, and wound as a package around a bobbin. More specifically, the fiber bundle forced out from the fiber-collecting section is drawn along the inner wall of the yarn drawing passage. At this time, the fiber bundle is drawn out while rotating along the inner wall of the yarn drawing passage due to the friction against that wall with the rotation of the rotor. This applies temporary twisting to the fiber bundle to help achieve the actual twisting.

The fiber bundle collected at the fiber-collecting section is however stuck on the inner wall of the fiber-collecting section only by the centrifugal force created by the rotation of the rotor. The fiber bundle drawn along the yarn drawing passage is thus twisted. This twisting propagates to the fiber bundle still stuck on the fiber-collecting section, causing the fiber bundle therein to rotate.

At the time of fiber twisting, therefore, sufficient tensile strength cannot be obtained so that the fibers would be twisted in a loose state. As a result, the fibers are not twisted stretched or in a tensed manner, weakening the yarn strength.

As a solution to this shortcoming, an apparatus as disclosed in Japanese Unexamined Patent Publication No. 51-64034 (see FIGS. 36 and 37) has been proposed. This apparatus has a disk-shaped draft rotor 93 provided inside an outer rotor 92 which has a fiber-collecting section 91. The draft rotor 93 makes a differential rotation to the outer rotor 92. The draft rotor 93 has a hole formed in its center in which a yarn guide duct (yarn drawing duct) 94 is loosely fitted. This hole perpendicularly intersects a draw hole 95 from which a fiber bundle F collected at the fiber-collecting section is drawn out. The draft rotor 93 is provided with a small disk 96 (shown in FIG. 37) which revolves while being pressed against the fiber bundle collected in the fiber-collecting section which also rotates.

In this apparatus, the draft rotor 93 rotates faster than the outer rotor 92 while having a predetermined rotational difference (a difference of almost 50 to several hundred turns per minute) with the outer rotor 92 to draw the fiber bundle F collected in the fiber-collecting section 91 through the draw hole 95. The fiber bundle F is therefore spun while being applied with a draft. Further, the fiber bundle F is spun while being drafted with the floating of the fiber bundle F being regulated by the action of the small disk 96.

Since this apparatus drafts the fiber bundle F while twisting it, however, the fibers on the fiber-collecting section 91 behave unstably, causing a variation in the thickness of the spun yarn. In other words, as the fiber bundle is drafted, some fibers are pulled while the rest stay unstretched, varying the thickness of the yarn. With fibers in different lengths as shown in FIG. 38, longer fibers $f_L$ are pulled, the rear end of a shorter fiber $f_s$ may be bent as shown in FIG. 39, reducing the yarn strength.

In addition, this apparatus has difficulty in keeping the small disk 96 rotating while being pressed against the fiber bundle F. Further, as the small disk 96 faces the fiber-collecting section 91, it is difficult for the opened fibers to enter the fiber-collecting section 91 when the small disk 96 comes to a position corresponding to the opening of the fiber supply passage. This state occurs every time the draft rotor 93 makes one turn, causing a variation in the fiber bundle F collected at the fiber-collecting section 91. This may not only cause the yarn to be cut frequently when spinning but also will reduce the quality of the spun yarn.

Japanese Unexamined Patent Publication No. 57-56528 discloses an apparatus as shown in FIG. 40. In this apparatus, an inner rotor 97 located inside an outer rotor 92, which has a fiber-collecting section 91, makes a differential rotation with respect to the outer rotor 92.

A spinning chamber 98 is provided in the inner rotor 97, with a fiber suction pipe 99 provided in the spinning chamber 98 to suck the fiber bundle F collected at the fiber-collecting section 91. As compressed air is supplied into the spinning chamber 98 via a hollow support shaft 100, an air vortex is generated. At the same time, the fiber bundle F collected at the fiber-collecting section 91 is sucked into the spinning chamber 98 via the fiber suction pipe 99 and is twisted due to the air vortex into yarn. Then, the yarn Y is expelled together with the expelling airstream toward a draw roller 101, and is drawn out by that roller 101.

However, this apparatus has a complicated inner-rotor structure and is difficult to manufacture. In addition, this apparatus is provided with no means to prevent the twisting applied on the fiber bundle F by the air vortex from propagating to that fiber bundle F which is still stuck on the fiber-collecting section 91. The twisting is thus applied to the fibers while the fibers are not sufficiently tense. Therefore, this apparatus still has the aforementioned conventional problem of not twisting the fibers in a stretched condition, preventing the yarn strength from being increased. Further, this apparatus uses inefficient compressed air that is used to generate inside the spinning chamber 98 of the inner rotor 97 an air vortex which has enough suction force to provide the fiber suction pipe 99 with a suction action to suck the fiber bundle F collected at the fiber-collecting section 91 of the outer rotor 92.

SUMMARY OF THE INVENTION

It is therefore a primary object of the present invention to provide a rotor type open-end spinning unit capable of permitting fibers constituting a fiber bundle, which is to be drawn out while being twisted into yarn, to be twisted in relatively stretched condition, yielding yarn with high tensile strength.

It is another object of the present invention to provide a rotor driving method which allows the rotor type open-end spinning unit to surely spin the intended yarn.

To achieve the first object, the spinning unit of the present invention has a yarn drawing passage provided on the open side of a rotor that rotates at a high speed together with a fiber-collecting section. A rotary assembly which is actively driven separately from the rotor is provided in the rotor on the same axial line as that rotor. The rotary assembly has at least part thereof facing the vicinity of the fiber-collecting section and another part shaped to face a first end of the yarn drawing passage. The rotary assembly is provided with a yarn passage for guiding a fiber bundle to a position opposite the yarn drawing passage from the vicinity of the fiber-collecting section. A twist propagation preventing portion is provided in the end of the yarn passage on the fiber-collecting section side.

To achieve the second object, the rotor driving method according to this invention drives the rotor and rotary assembly of a spinning unit with the aforementioned structure in such a way that the diameter of the fiber-collecting section, D, the number of rotations of the rotor, $R_2$, the number of rotations of the rotary assembly, $R_2$, and a yarn drawing speed V satisfy the relation of the following equation:

$$\pi DR_1+0.8V \leqq \pi DR_2 \leqq \pi DR_1+V.$$

When the rotor and rotary assembly are driven under this condition, the fiber bundle will not be drafted substantially but the driving is merely enough to apply even tension to the fibers constituting the fiber bundle. This can prevent variation in the thickness of the fiber bundle which may otherwise be caused by drafting the fiber bundle while twisting it. It is also possible to prevent the case where, with fibers arranged in different lengths, pulling longer fibers causes the rear end of a shorter fiber to be bent, reducing the yarn strength.

The rotary assembly may be provided with a fiber-entwining preventing portion at the upstream of the twist propagation preventing portion and closer to the fiber-collecting section but at a position opposite to a separating-point in the moving direction of the fiber bundle that is being separated from the fiber-collecting section. In this case, there will not be any fibers that entwine the fiber bundle in a coil shape in the opposite direction to the twisting direction of yarn, so that a cloth made of the produced yarn may have good texture.

Further, a resisting member which contacts the surface of the fiber bundle without interfering with the rotation of the fiber bundle may be provided between the actual twisting point of the yarn drawing passage and the twist propagation preventing portion. In this case, nap on the surface entwines the outer surface of the fiber bundle in a spiral form, so that the fibers coiled softly on the surface portion are entwined firmly to tighten the inner fibers. As the outer layer of fibers and the nap entwine around the fiber bundle, the yarn is tightened so that a cloth made of this yarn will have good texture.

A negative pressure generating device may be provided in the yarn drawing passage at a position closer to the yarn-drawn side than the twist start point. In this case, the negative pressure generating device generates a suction airstream moving toward the yarn passage, smoothing the separation of the fiber bundle and the guiding thereof into the yarn passage.

Furthermore, a wedge-shaped recess may be provided as the twist propagation preventing portion at the corner of an inlet portion of the yarn passage on the side of the separating-point moving direction of the fiber bundle, or a corrugation smaller than the diameter of the fiber bundle but larger than that of a fiber may be formed at the corner of an inlet portion of the yarn passage on the side of the separating-point in the moving direction of the fiber bundle in such a way as to extend in the direction of drawing the fiber bundle.

A pair of contact members which contact the fiber bundle from both sides may be used as the twist propagation preventing portion.

DETAILED DESCRIPTION OF THE PREFERRED EMBODIMENTS

First Embodiment

Figure 1:
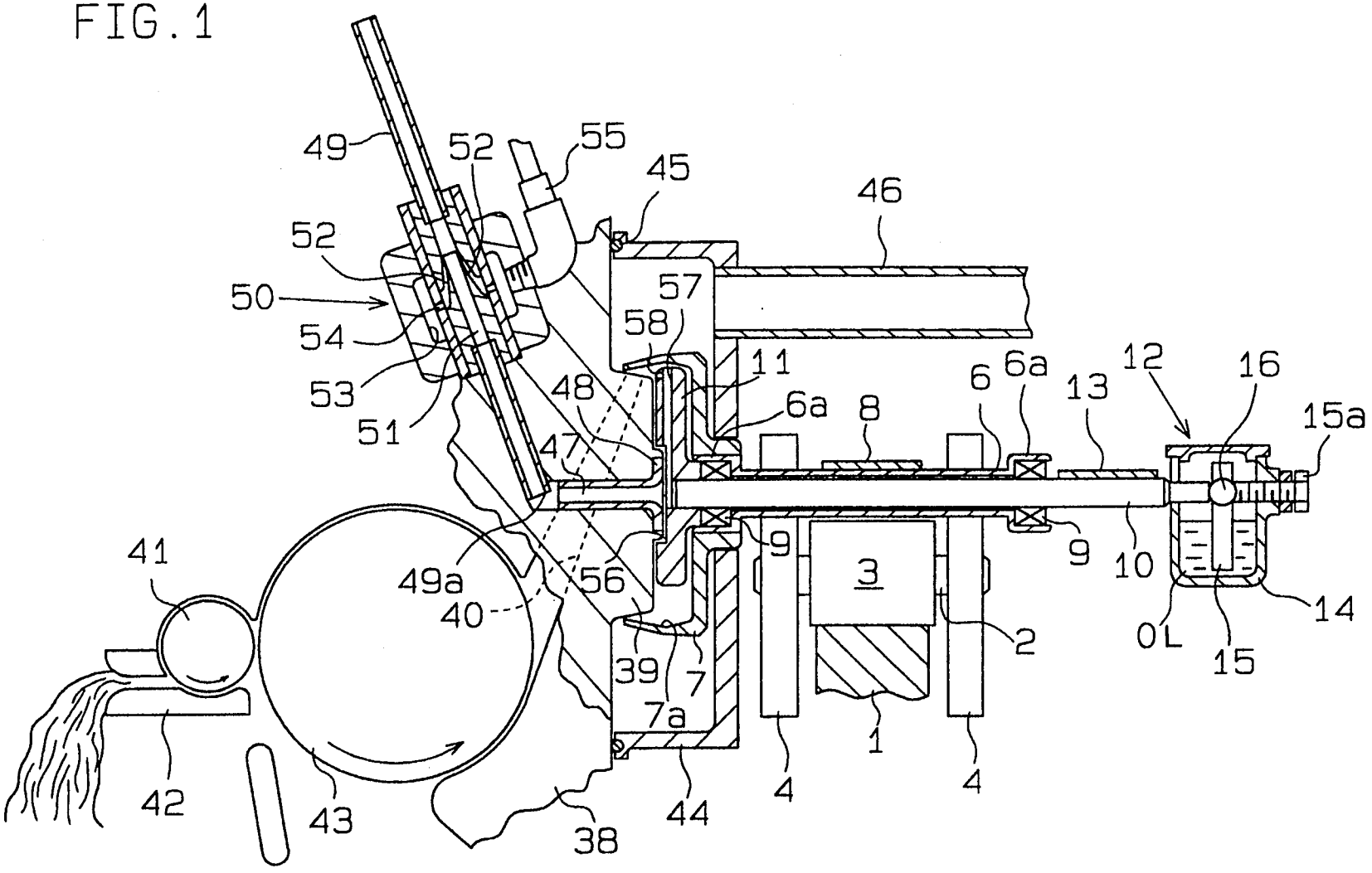
FIG. 1 is a partial cross section of a first embodiment of the present invention.
Figure 4:
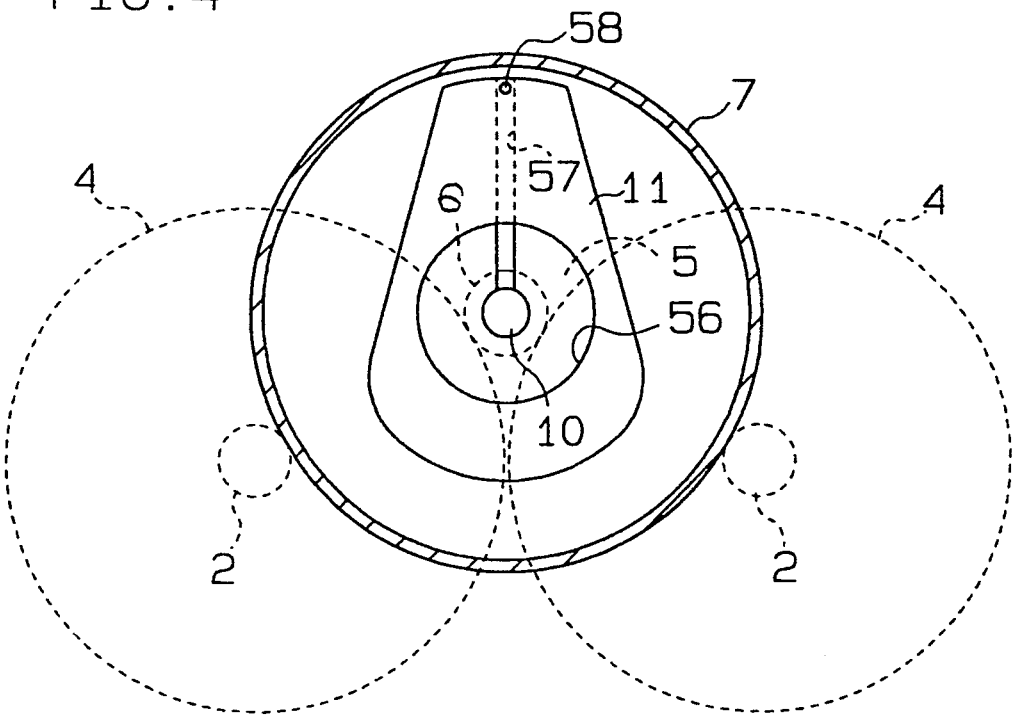
FIG. 4 is a partial cross section illustrating the relation between the rotor and rotary assembly, and a support disk and a rotor shaft as viewed from the open side of the rotor.

A first embodiment of the present invention will now be described referring to FIGS. 1 through 4;

As shown in FIG. 1, a pair of drive shafts 2 (only one shown) are supported via bearings 3 in parallel on a base 1 fixed to a machine frame (not shown). Support disks 4 are fitted rotatably over both ends of each drive shaft 2. As shown in FIG. 4, each adjoining pair of support disks 4 defines a wedge-shaped recess 5. A hollow rotor shaft 6 is supported in the wedge-shaped recess 5, with its outer surface contacting both support disks 4. A rotor 7 is securely fitted over a first end portion of the rotor shaft 6. Between the pair of support disks 4, a drive belt 8 common to a plurality of spindles is disposed in a direction perpendicular to the rotor shaft 6 while pressing the rotor shaft 6 against the support disks 4.

Bearings 9 are fixed in large-diameter portions 6*a* formed at both ends of the rotor shaft 6. A shaft 10 penetrating the rotor shaft 6 is rotatably supported on the same axial line as the rotor shaft 6 via the bearings 9. The shaft 10 has a first end portion rotatably supporting a rotary assembly 11 and a second end portion abutting on a thrust bearing 12. A drive belt 13, provided common to a plurality of spindles like the drive belt 8, is pressed against the shaft 10 in such a way as to run in the direction perpendicular to the shaft 10. As the drive belt 13 runs, the shaft 10 rotates.

The thrust bearing 12 has a case 14 for retaining a lubrication oil OL, with an oil supplying member 15 made of felt being accommodated in the case 14. A ball 16 is supported on the case 14, an adjusting screw 15*a* abutting on the ball 16 from the opposite side of the shaft 10. The support disks 4, like those disclosed in U.S. Pat. No. 3,779,620, are fixed to the drive shaft 2 with slight tilting, so that when the support disks 4 rotate, the thrust load toward the thrust bearing 12 acts on the rotor shaft 6. The thrust load acting on the rotor shaft 6 is transmitted via the bearings 9 to the shaft 10 and is received by the thrust bearing 12.

Figure 3:
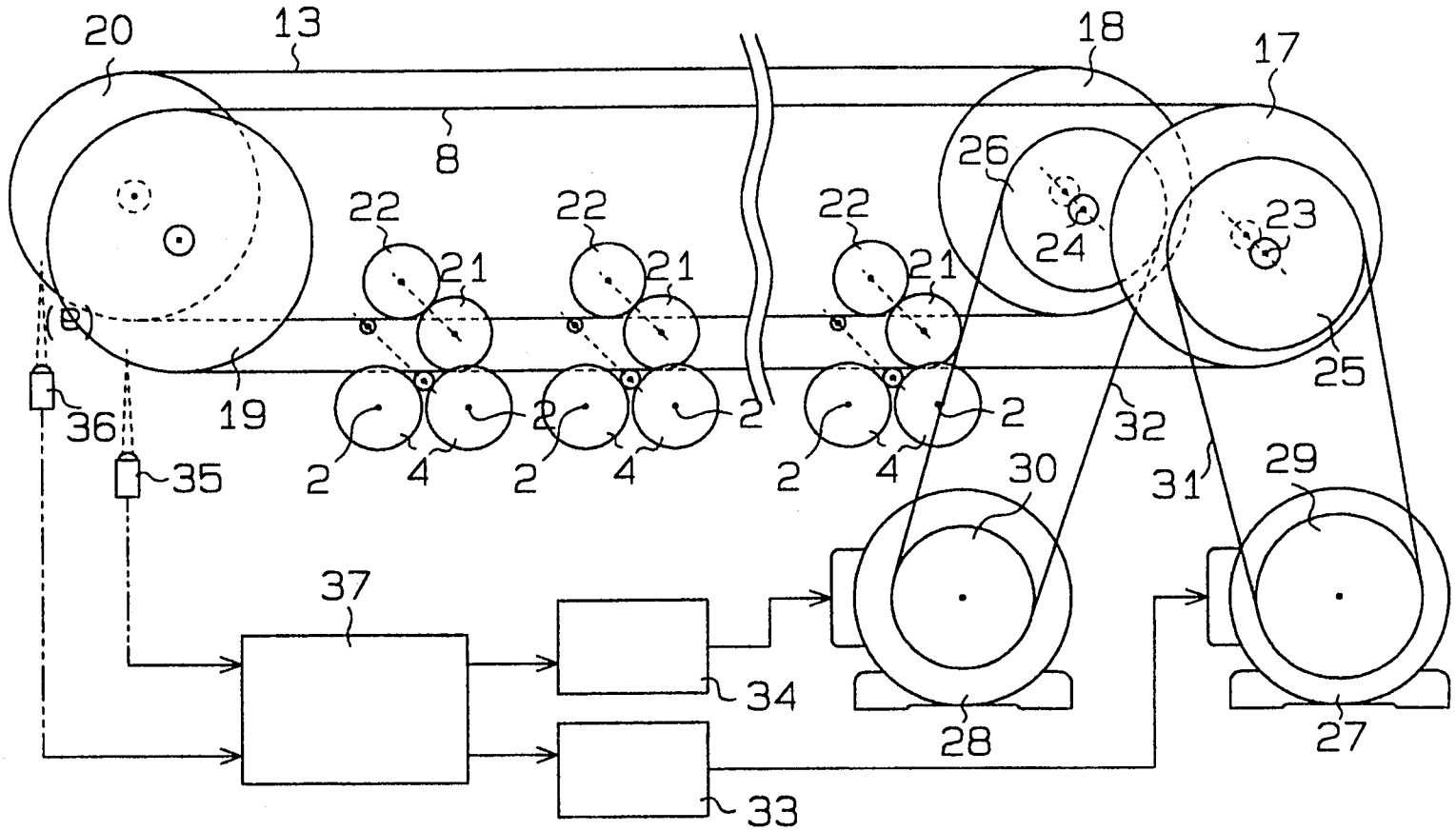
FIG. 3 is a schematic diagram illustrating the driving system for a rotor and a rotary assembly.

As shown in FIG. 3, the drive belt 8 is put around a drive pulley 17 and a driven pulley 19, and the drive belt 13 around a drive pulley 18 and a driven pulley 20. The drive belts 8 and 13 are respectively pressed against the rotor shaft 6 and the shaft 10 by respective press rollers 21 and 22 provided for each spindle. Counter pulleys 25 and 26 are securely fitted rotatable over respective drive shafts 23 and 24 over which the drive pulleys 17 and 18 are respectively fitted securely. A belt 31 is put around the counter pulley 25 and a motor pulley 29 fitted over the drive shaft of a motor 27, and a belt 32 around the counter pulley 26 and a motor pulley 30 fitted over the drive shaft of a motor 28.

Both motors 27 and 28 are constituted of variable-speed motors whose speeds can be controlled via inverters 33 and 34, respectively. Rotational speed sensors 35 and 36, which detect the number of rotations of the driven pulley 19 and that of the driven pulley 20, are disposed at positions corresponding to the driven pulleys 19 and 20, respectively. The detections signals of the rotational speed sensors 35 and 36 are input to a controller 37 which provides the inverters 33 and 34 with speed commands. The controller 37 controls the driving of the motors 27 and 28 via the inverter 33 and 34 in such a way that the rotor 7 and the rotary assembly 11 are driven at predetermined rotational speeds corresponding to the spinning conditions that have been input in advance by an input device (not shown).

Figure 2:
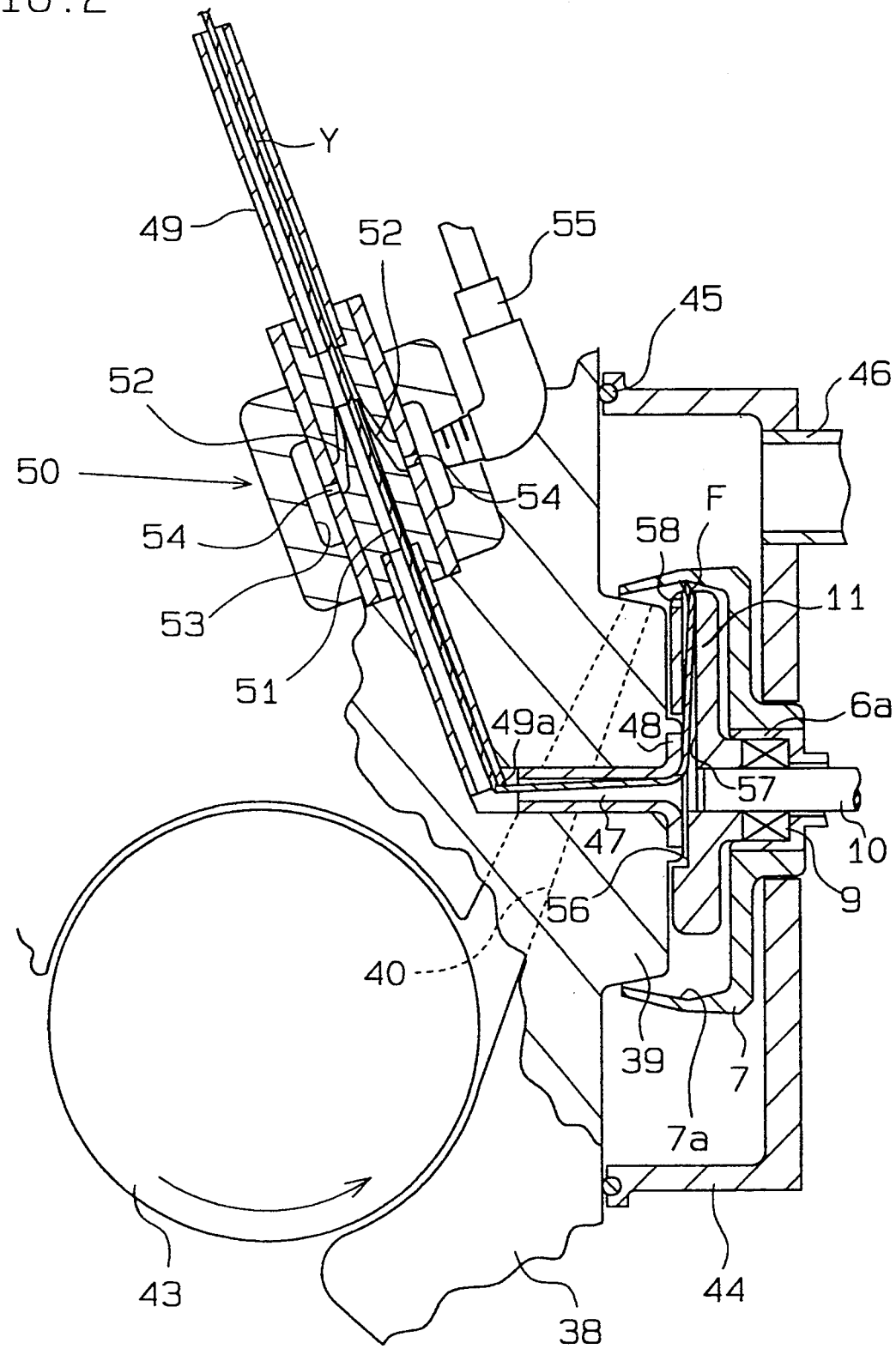
FIG. 2 is a partly enlarged cross-sectional view.

As shown in FIGS. 1 and 2, a boss portion 39 formed in a housing 38 disposed opposite the opening side of the rotor 7 protrudes inside the rotor 7. A fiber transport channel 40 is bored through the boss portion 39. The fiber transport channel 40 serves to guide fibers, which are supplied by a feed roller 41 and a presser 42 and opened by a combing roller 43, into the rotor 7. A casing 44, which covers the rotor 7, is disposed opposite the housing 38 in such a way as to abut on the housing end via an O ring 45. The casing 44 is connected via a pipe 46 to a negative-pressure source (not shown).

A navel (guide member) 48 is disposed in the center of the boss portion 39. Formed in the navel 48 is a guide hole which constitutes part of a yarn drawing passage 47, a first end portion of the guide hole being open on the side of the rotor 7. An ejector 50 as a negative pressure generating device is provided in midway of a yarn pipe 49 which constitutes the downstream portion of the yarn drawing passage 47. The yarn pipe 49 is so disposed as to intersect the center line of the navel 48. The end portion 49*a* of the yarn pipe 49 at the navel 48 is the point at which twisting of yarn starts.

The ejector 50 has a passage 51 provided in the center portion of the ejector 50, a plurality of eject holes 52 provided outside the passage 51 for ejecting compressed air toward the outlet side (yarn drawing side) of the passage 51, and a ring chamber 53 provided outside the ejector holes 52. The chamber 53 communicates with the eject holes 52 via a hole 54, and is provided with an opening to which a compressed air supply pipe 55 is connected. This pipe 55 is connected to a compressed air source (not shown), and is provided with a pressure regulator and a valve (neither shown) midway thereof. As compressed air with predetermined pressure supplied via the compressed air supply pipe 55 from the compressed air source is ejected through the eject holes 52, the ejector 50 generates negative pressure on the inlet side of the passage 51.

The rotary assembly 11 is shaped so that part of its peripheral surface extends to near a fiber-collecting section 7*a* of the rotor 7. A recess 56 is formed in the center portion of that side of the rotary assembly 11 which corresponds to the boss portion 39. The rotary assembly 11 is provided in such a manner that the navel 48 is loosely fitted in the recess 56. The rotary assembly 11 has its largest outer diameter portion formed larger than the opening end of the rotor 7. A yarn passage 57 is formed in the largest outer diameter portion of the rotary assembly 11 in such a manner as to extend radially from the center of the rotary assembly 11. The yarn passage 57 is formed in such a way that its first end portion is open to the vicinity of the fiber-collecting section 7*a* and its second end portion is open to the position facing the yarn drawing passage 47 or to the bottom of the recess 56. The rotary assembly 11 is fixed to the shaft 10 to make the gap between itself and the end face of the boss portion 39 as narrow as possible in order to improve the sealing between the boss portion 39 and the rotary assembly 11.

A hole 58, which allows the yarn passage 57 to be open to the side of the housing 38, is formed in the distal end of the rotary assembly 11. The hole 58 constitutes twist propagation preventing means which prevents twisting of the fiber bundle that is moving along the yarn passage 57 from propagating toward the upstream of that point. The hole 58 allows air inside the rotor 7 to be forced into the yarn passage 57 based on the negative pressure in the yarn passage 57 which is created by the action of the ejector 50. This presses the fiber bundle moving in the yarn passage 57, thus preventing the propagation of twist toward the upstream of that point.

The action of the spinning unit having the above-described structure will be described below.

Before the operation of the machine, spinning conditions are input via the input device to the controller 37. When the machine is operated, the frequency and voltage based on the speed instruction signal from the controller 37 are output from the inverters 33 and 34 to the motors 27 and 28 to drive both motors. As the motors 27 and 28 are driven, the drive pulleys 17 and 18 are rotated via the motor pulleys 29 and 30, belts 31 and 32, counter pulleys 25 and 26, and drive shafts 23 and 24. As a result, the drive belts 8 and 13 run in the same direction to thereby rotate the rotors 7 and rotary assembly 11 in the same direction via the rotor shaft 6 and the shaft 10.

The controller 37 drives the motors 27 and 28 in such a manner as to satisfy the relation given in the following equation and to provide predetermined numbers of rotations $R_1$ and $R_2$ suitable for the spinning conditions:

$$\pi DR_1+0.8V \leqq \pi DR_2 \leqq \pi DR_1+V$$

where D is the diameter of the fiber-collecting section 7*a*, $R_1$ is the number of rotations of the rotor 7, $R_2$ is the number of rotations of the rotary assembly 11, and V is the spinning speed (yarn drawing speed).

The controller 37 receives the detection signals from the rotation speed sensors 35 and 36, and computes the numbers of rotations of the driven pulleys 19 and 20 based on the values of those signals. With the number of rotations of the driven pulley 19 for the rotor 7 taken as a reference, the controller 37 computes the number of rotations of the driven pulley 20 for the rotary assembly 11 corresponding to the former number of rotations, and compares the resultant value with the actual number of rotations. When the actual number of rotations exceeds the reference value by a predetermined range, the controller 37 changes the speed of the motor 28 to make the number of rotations approach the reference value. As the speeds of the rotor 7 and the rotary assembly 11 can be controlled separately from those of the motors 27 and 28 that are different drive sources, it is possible to easily deal with a change in the spinning conditions.

The rotary assembly 11 rotates at the speed of separating the fiber bundle from the fiber-collecting section 7*a*, different from the rotation speed of the rotor 7. The speed of separating the fiber bundle is slightly faster than the rotational speed of the rotor 7. Compressed air is supplied to the ejector 50 from the compressed air source via the compressed air supply pipe 55. As a result, the pressure in the yarn drawing passage 47 at the upstream (the rotor (7) side) of the ejector 50 drops lower than the negative pressure inside the rotor 7, creating a suction action. Under this condition, the fibers opened by the combing roller 43 are fed into the rotor 7 via the fiber transport channel 40. The opened fibers slide along the inner wall of the rotor 7 and are collected at the fiber-collecting section 7*a* which is the largest inner diameter portion. Thereafter, the fiber bundle F is smoothly separated from the fiber-collecting section 7*a* by the sucking airstream generated based on the negative pressure in the yarn passage 57, and is guided into the yarn passage 57.

The fiber bundle F is linked tp yarn Y that is drawn out via the yarn pipe 49 by a draw roller (not shown). As the yarn Y is drawn out, therefore, the fiber bundle F is drawn out as the yarn Y while being twisted by the rotation of the rotary assembly 11. The twist applied to the yarn Y and the fiber bundle F propagates from the end portion 49*a* of the yarn pipe 49 as the start point to the upstream (the fiber-collecting section (7*a*) side). That is, the end portion 49*a* becomes the actual twisting point. A temporary twist created by the friction between the yarn Y and the guide wall of the navel 48 helps the twist propagate.

Air is sprayed onto the distal end of the yarn passage 57 from the hole 58. This airstream presses the fiber bundle F moving in the yarn passage 57 against the wall of the yarn passage 57 at the position corresponding to the hole 58. Consequently, the rotation of the fiber bundle F is suppressed at that portion. The rotation of the yarn passage 57 and the fiber bundle F, which are being drawn out while being twisted, is therefore suppressed from being transmitted to the upstream fiber bundle F. More specifically, the twist of the fiber bundle F is stopped at the position corresponding to the hole 58. At the twisting time, therefore, the fiber bundle F is twisted with the fibers drafted by the application of tension to the fibers. The fibers are thus twisted stretched to increase the yarn strength, yielding well-tightened yarn.

Since the propagation of the twist of the fiber bundle F to the upstream of the position corresponding to the hole 58 is prevented as described above, the fiber bundle F that has just been separated from the fiber-collecting section 7a has a low strength. As the rotary assembly 11 is driven at a given speed as separate from the rotor 7, the force acting on the fiber bundle F at the time of the fiber separation becomes stable, smoothing the separation of the fiber bundle F. And the suction airstream toward the yarn passage 57 generated by the ejector 50 makes the separation of the fiber bundle F and the guiding thereof into the yarn passage 57 smoother.

At the time yarn is joined, the supply of compressed air to the ejector 50 is stopped. The yarn Y is smoothly inserted into the rotor 7 from the yarn pipe 49 in the reverse direction via the yarn drawing passage 47 and the yarn passage 57.

While the drawing speed V of the spinning yarn is greater than the speed of separating the fiber bundle F, ($\pi DR_2 - \pi DR_1$), it is 1.25 times greater at a maximum. That is, $$\pi DR_1 + 0.8\ V \leqq \pi DR_2 \leqq \pi DR_1 + V$$

The tension of the fibers of the open-end yarn (the ratio to the length of the yarn when the fibers are stretched fully) is approximately 80%. With the mentioned speed difference, the fiber bundle F will not be drafted substantially, and the driving is merely enough to apply uniform tension to the fibers constituting the fiber bundle. This can prevent a variation in the thickness of the fiber bundle which may otherwise be caused by drafting the fiber bundle while twisting it. It is also possible to prevent the case where, with fibers in different lengths arranged, pulling longer fibers causes the rear end of a shorter fiber to be bent, reducing the yarn strength.

Second Embodiment

Figure 5:
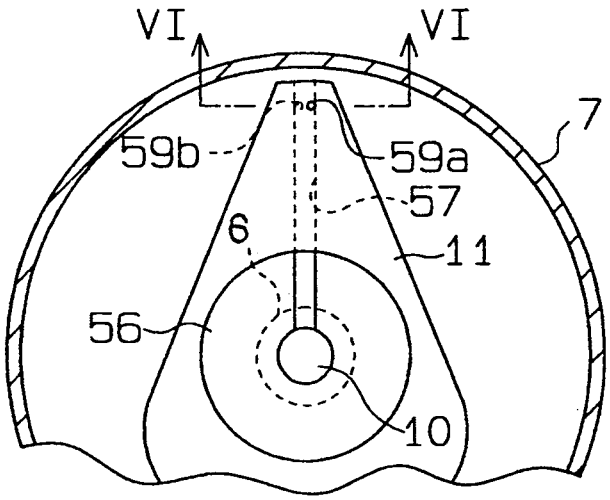
FIG. 5 is a partial cross-sectional view showing essential portions of a second embodiment.
Figure 6:
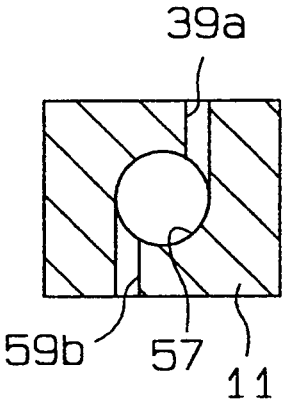
FIG. 6 is an enlarged cross section taken along the line VI—VI in FIG. 5.

A second embodiment will now be described referring to FIGS. 5 and 6. This embodiment differs from the first embodiment in the structure of the twist propagation preventing means provided at the distal end of the rotary assembly 11, and is identical in the other structure.

More specifically, a pair of holes 59a and 59b are formed in the distal end portion of the rotary assembly 11 at the position corresponding to the yarn passage 57 in such a manner as to extend in the width direction of the rotary assembly 11 and generate a vortex in the yarn passage 57 in the opposite direction to the direction of twist applied to the fiber bundle F. According to the structure of the second embodiment, airstream forced into the yarn passage 57 from both holes 59a and 59b based on the negative pressure in the yarn passage 57 becomes a vortex. This airstream applies force to the fiber bundle F, which is twisted by the rotation of the rotary assembly 11, to rotate the fiber bundle F in the direction opposite to the twisting direction, thus suppressing the propagation of the twist to the fiber bundle located upstream of the position corresponding to both holes 59a and 59b. At the time the fiber bundle is twisted, therefore, tension is applied to the fibers so that the fiber bundle is twisted with the fibers stretched, as in the previous embodiment. The fibers are thus twisted stretched to increase the yarn strength, yielding well-tightened yarn.

Third Embodiment

Figure 7:
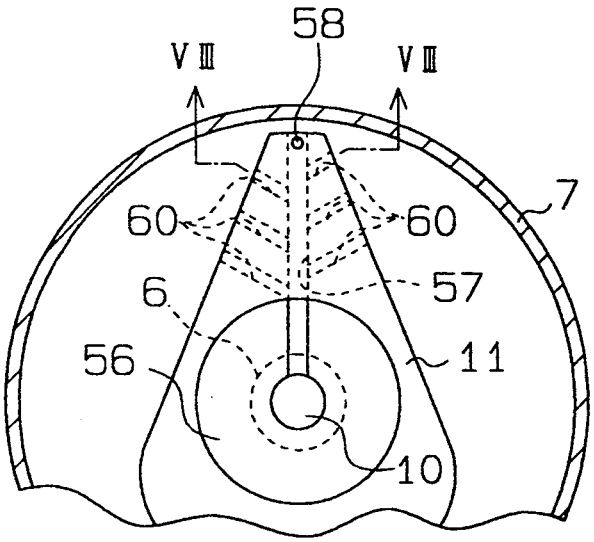
FIG. 7 is a partial cross-sectional view showing essential portions of a third embodiment.
Figure 8:
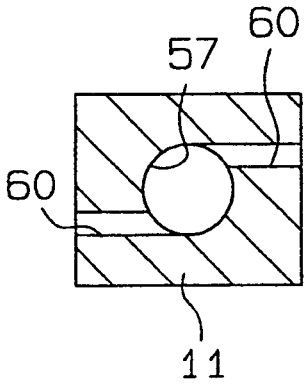
FIG. 8 is an enlarged cross section taken along the line VIII—VIII in FIG. 7.

A third embodiment will now be described referring to FIGS. 7 and 8. This embodiment differs from the first embodiment in that means for applying temporary twist to the fiber bundle in the yarn passage 57 in the same direction as the direction of the twist applied by the rotation of the rotary assembly 11 is added to the spinning unit of the first embodiment.

The hole 58 as the twist propagation preventing portion is formed at the distal end of the rotary assembly 11. A number of bores 60 for producing a swirl airstream in the same direction as the yarn twisting direction are formed in the yarn passage 57 between the recess 56 and the hole 58. In the spinning unit of this embodiment, when the spinning is executed, twist is applied to the fiber bundle moving in the yarn passage 57 by the rotation of the rotary assembly 11 while temporary twist acting in the same direction as the actual twist is applied to the fiber bundle by the jet stream coming through the bores 60. The rotation of the fiber bundle is suppressed at the position corresponding to the hole 58, thus preventing the twist applied to the fiber bundle from propagating upstream of the position corresponding to the hole 58. The strength of the fiber bundle moving in the yarn passage 57 therefore increases, providing an improved spinning performance in addition to the advantages of the previous two embodiments.

Fourth Embodiment

Figure 9:
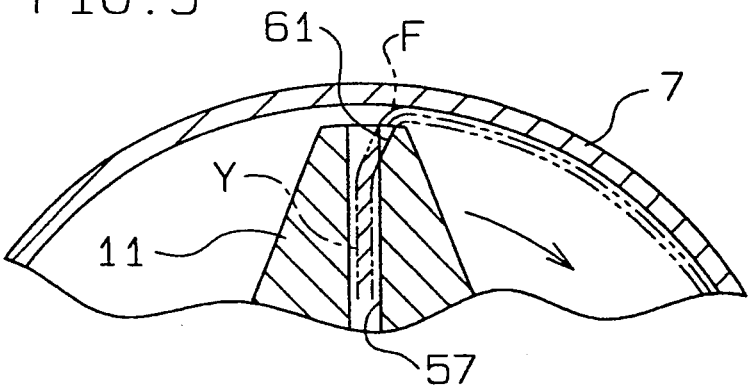
FIG. 9 is a partly enlarged cross-sectional view illustrating the relation between the distal end portion of a rotary assembly and a rotor according to a fourth embodiment.
Figure 10:
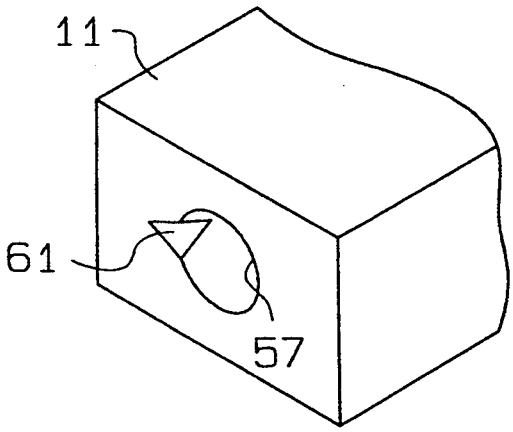
FIG. 10 is a partial perspective view of the rotary assembly.

A fourth embodiment will now be described referring to FIGS. 9 and 10. This embodiment differs from the previous three embodiments in that the prevention of the twist propagation is effected based on the action of airstream in any of the three embodiments, whereas this fourth embodiment provides the inlet portion of the yarn passage 57 with a structure which applies a frictional resistance to stop the rotation of the fiber bundle F. The other structure is basically the same as that of the previous embodiments.

A wedge-shaped recess 61 is provided as the twist propagation preventing portion at the corner of the inlet portion of the yarn passage 57 on the side of the separating-point moving direction of the fiber bundle. The recess 61 extends in the drawing direction of the fiber bundle F and has its opening end portion formed wider than the diameter (thickness) of the fiber bundle F.

In this embodiment, the rotary assembly 11 rotates in the same direction (in the arrow direction in FIG. 9) as the rotor 7 at a slightly slower speed than the rotor 7. The speed of drawing the yarn Y is set slightly faster than the rotational speed of the rotor 7.

As a result, the fiber bundle F is sequentially separated from the fiber-collecting section 7a at the front side of the inlet portion in the rotational direction of the rotary assembly 11. At the time the fiber bundle F is guided into the yarn passage 57, the separated fiber bundle F passes the recess 61 while being pressed against it and moves into the yarn passage 57. As the recess 61 is shaped like a wedge, even if the fiber bundle F attempts to rotate at the position corresponding to the recess 61, it cuts deeply into the wedge and its rotation is stopped. This prevents the twist applied to the fiber bundle F from propagating to the upstream of the position corresponding to the recess 61. The recess 61 need not be formed deep enough to receive the fiber bundle F completely.

Fifth Embodiment

Figure 11:
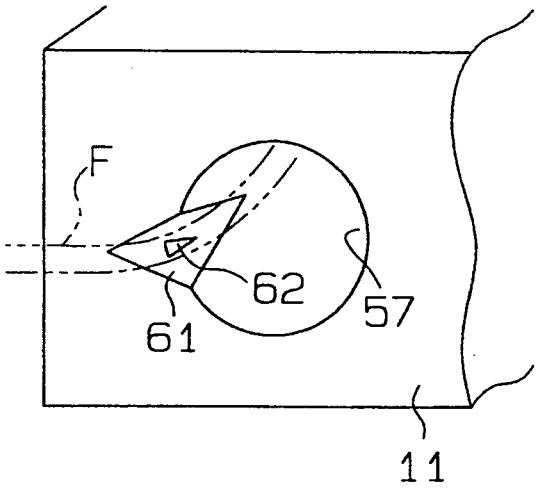
FIG. 11 is a partial perspective view of a rotary assembly according to a fifth embodiment.
Figure 12:
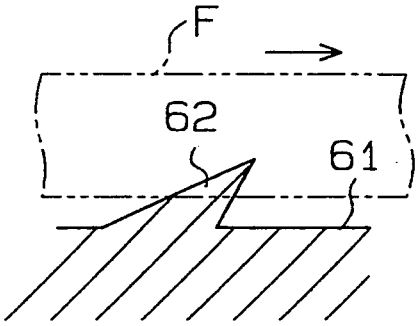
FIG. 12 is a partly enlarged cross section of a projection cut at a plane along the lengthwise direction of a recess.

A fifth embodiment will now be described referring to FIGS. 11 and 12. This embodiment differs from the fourth embodiment in that a projection 62 is provided in the recess 61. The projection 62 is formed in the center of the bottom of the recess 61, as shown in FIG. 11, and protrudes obliquely in the moving direction of the fiber bundle F, as shown in FIG. 12. In this embodiment, therefore, at the time the fiber bundle F passes the recess 61, the projection 62 enters the fiber bundle F to surely stop the rotation of the fiber bundle F.

Sixth Embodiment

Figure 13:
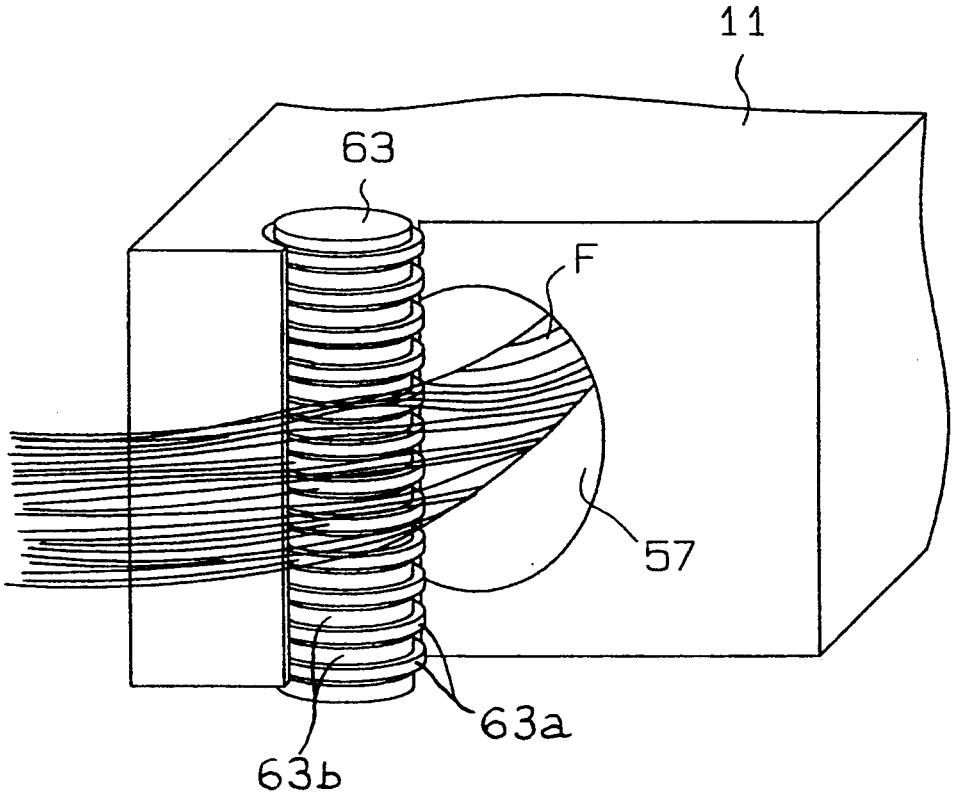
FIG. 13 is a perspective view of essential portions of a sixth embodiment.

A sixth embodiment will now be described referring to FIG. 13. This embodiment, like the fourth and fifth embodiments, has a structure that does not use the action of an airstream to stop the twist propagation.

The twist propagation preventing portion is provided at the corner of the inlet portion of the yarn passage on the side of the separating-point moving direction of the fiber bundle. The twist propagation preventing portion is constituted by a shaft 63 that has many long projections 63*a* and long recesses 63*b* formed on its outer surface, which alternately extend in the circumferential direction. The shaft 63 is fixed to the distal end of the rotary assembly 11 in such a way as to interest the moving direction of the fiber bundle F. The shaft 63 is secured by means of screwing into the rotary assembly 11, or by an adhesive, press fitting, etc. The projections 63*a* and recesses 63*b* extend in the drawing direction of the fiber bundle F and are formed smaller than the diameter of the fiber bundle F and larger than the diameter of the fibers. It is preferable that the shaft 63 be made of a wear-resistant material, such as ceramics.

In this embodiment too, the rotary assembly 11 rotates at a slightly slower speed than the rotor 7, and the speed of drawing the yarn Y is set slightly faster than the rotational speed of the rotor 7. Accordingly, the fiber bundle F is sequentially separated from the fiber-collecting section 7*a* and is guided into the yarn passage 57. The fiber bundle F is guided into the yarn passage 57 while always engaging with the projections 63*a* and recesses 63*b*. When passing the projections 63*a* and recesses 63*b*, the fiber bundle F is separated into multiple portions there, by the projections 63*a* and recesses 63*b*. Since the projections 63*a* and recesses 63*b* extend in the drawing direction of the fiber bundle F, the drawing resistance of the fiber bundle F is small but the rotation of the fiber bundle F is surely stopped. The twist applied to the fiber bundle F is therefore surely prevented from propagating to the upstream of the position corresponding to the projections 63*a* and recesses 63*b*. In the fifth embodiment, there is a chance that the fiber bundle F passes through the inlet portion without being surely engaged with the recess 61, whereas in this embodiment, there is no such possibility. This is because, as the projections 63*a* and recesses 63*b* are provided over the entire corner portion on that side of the separating-point moving direction of the fiber bundle F, the fiber bundle F is surely engaged with the projections 63*a* and recesses 63*b* at the time it is guided into the yarn passage 57.

The optimal sizes of projections 63*a* and recesses 63*b* vary depending on the spinning conditions, such as the type of fibers, the thickness of spun yarn and the drawing speed. It is therefore preferable that the shaft 63 is designed to be detachable and that a plurality of shafts 63 with different projections 63*a* and recesses 63*b* are provided to ensure replacement with the proper shaft that matches the spinning conditions.

Seventh Embodiment

Figure 14:
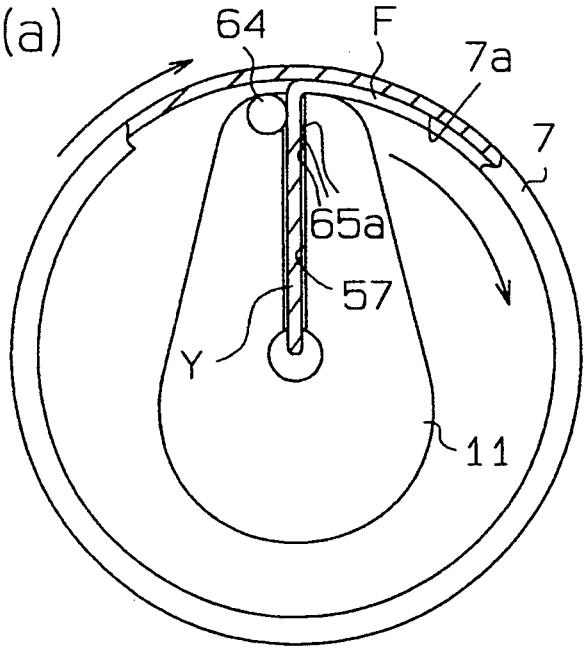
FIG. 14*a* is a view illustrating a rotary assembly according to a seventh embodiment from the opening side of a rotor.
FIG. 14*b* is a diagram showing a modification of twist propagation preventing means according to the seventh embodiment.
Figure 14:
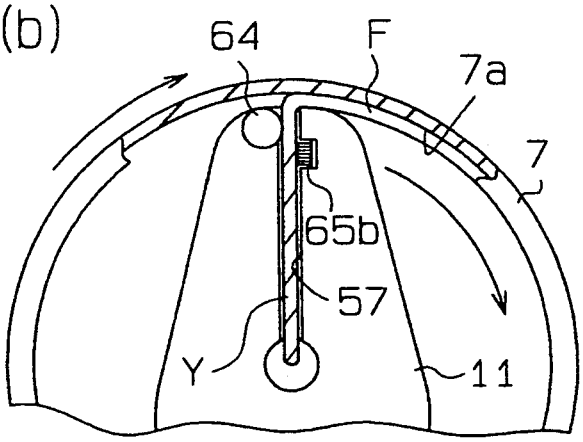

A seventh embodiment will now be described referring to FIGS. 14 through 20. This embodiment differs greatly from the previous embodiments in that a fiber-entwining preventing means (fiber-entwining preventing portion in the German application) is provided upstream of the twist propagation preventing means. As shown in FIG. 14A, the yarn passage 57 formed in the rotary assembly 11 is designed as a recess with that side of the boss portion 39 open. A pin 64 that serves as the fiber-entwining preventing means is provided at the inlet side end of the yarn passage 57 and on the wall thereof opposite to the wall that comes in front in the rotational direction of the rotary assembly 11. A plurality of pins 65*a* are provided on that wall of the yarn passage 57 which lies on side of the rotational direction of the rotary assembly 11, in the vicinity and downstream of the pin 64; the pins 65*a* are formed perpendicular to the yarn passage 57. The pins 65*a* constitute the twist propagation preventing portion. Alternately, a brush 65*b* may be provided as the twist propagation preventing portion as shown in FIG. 14B.

As the twist applied to the yarn Y and fiber bundle F propagates in the direction perpendicular to the pins 65*a* with the fiber bundle F pressed against the pins 65*a*, the rotation of the fiber bundle F is suppressed there. This suppresses the transmission of the rotation of the yarn Y and fiber bundle F, which are drawn out while being twisted, to the fiber bundle F located upstream of the position corresponding to the pins 65*a*. At the time the fiber bundle F is twisted, therefore, tension is applied to the fibers so that the twist is effected while the fibers are stretched.

Figure 15:
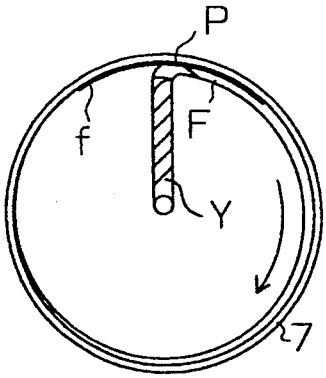
FIGS. 15 through 17 are exemplary diagrams illustrating entwining of fibers when there is no fiber-entwining preventing portion.
Figure 16:
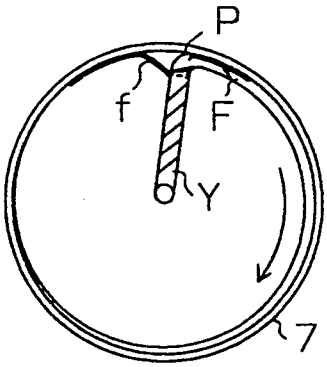
Figure 17:
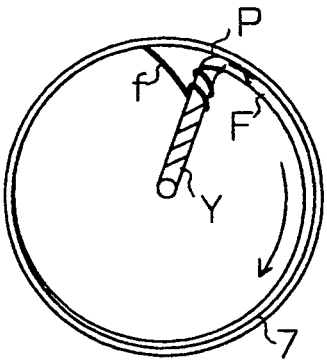

Since the rotary assembly 11 rotates at a speed equal to the moving speed of the separating point P, the pin 64 moves along the fiber-collecting section 7*a* while always being close to the separation point P. Thus, when those fibers f which are present over the separation point P at the fiber-collecting section 7*a* entwine the fiber bundle F that is separated from the fiber-collecting section 7*a*, the movement of the fibers f is restricted by the pin 64. Those fibers lying in front of the separation point in the moving direction are twisted together with the other fibers in the same direction, regardless of whether or not the pin 64 is present. If there were no pin 64, in accordance with the drawing of the fiber bundle F, those fibers behind the separation point in the moving direction would entwine around the fiber bundle like a coil in the direction opposite to the twisting direction of the other fibers while being stretched toward the center of the rotor 7, as shown in FIGS. 15 to 17.

Figure 18:
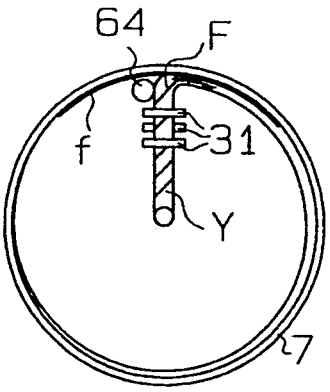
FIGS. 18 through 20 are exemplary diagrams illustrating the action when there is a fiber-entwining preventing portion.
Figure 19:
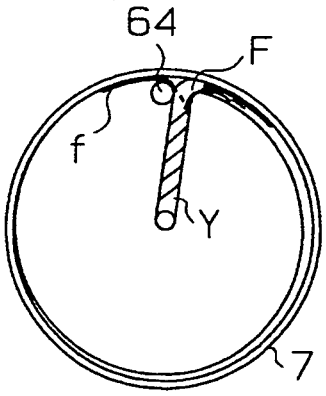
Figure 20:
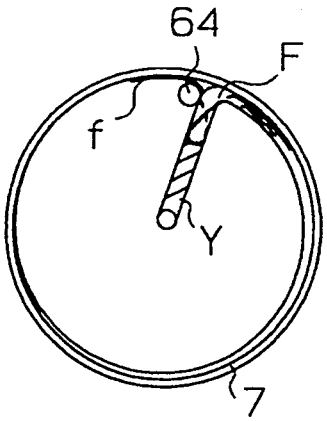
Figure 21:
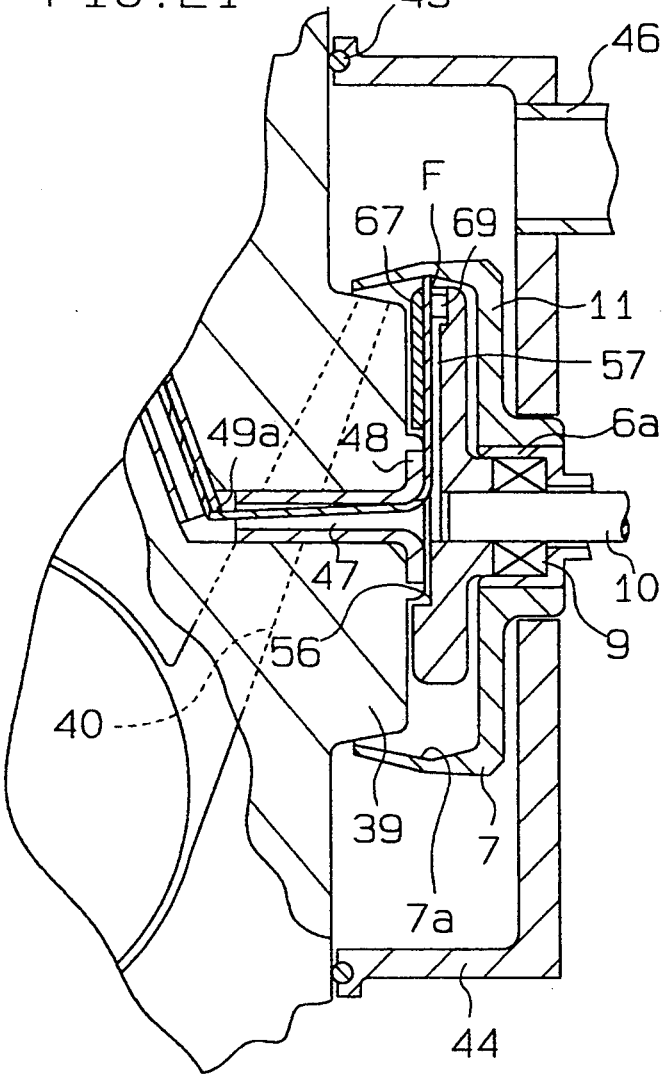
FIG. 21 is a partly enlarged cross section of an eighth embodiment.
Figure 22:
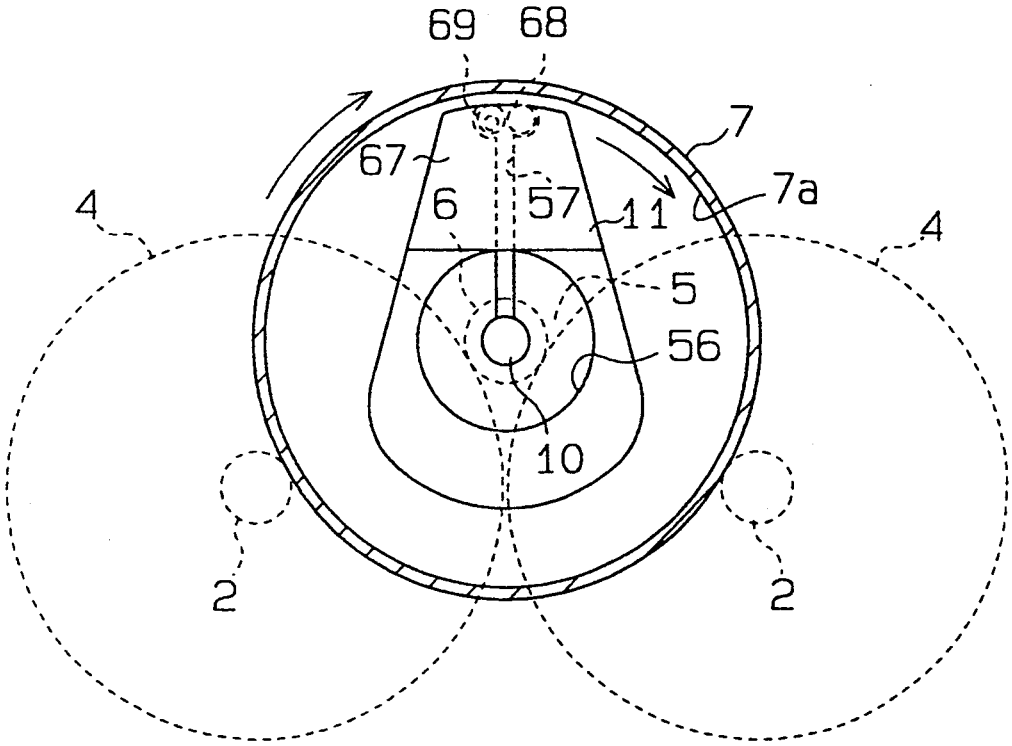
FIG. 22 is a partial cross section illustrating the relation between the rotor and rotary assembly, and a support disk and a rotor shaft as viewed from the opening side of the rotor.

With the pin 64 present, however, the fibers f are restricted by the pin 64 and join the other fibers of the fiber bundle F that are being drawn out, near the separation point P, as shown in FIGS. 18 to 20. When passing the engaging portion with the twist propagation preventing portion, the fibers f are twisted together with the other fibers and drawn out as yarn.

If the fibers f are coiled around the fiber bundle F in the opposite direction to the yarn twisting direction, the yarn bending stiffness becomes greater, giving harder feeling when the yarn is made into a cloth as well as impairing the appearance. The provision of the fiber-entwining preventing portion as in this embodiment eliminates those fibers which would otherwise coil around the yarn in the direction opposite to the yarn twisting direction. Naturally, a cloth made of the produced yarn will have good texture.

Eighth Embodiment

Figure 25:
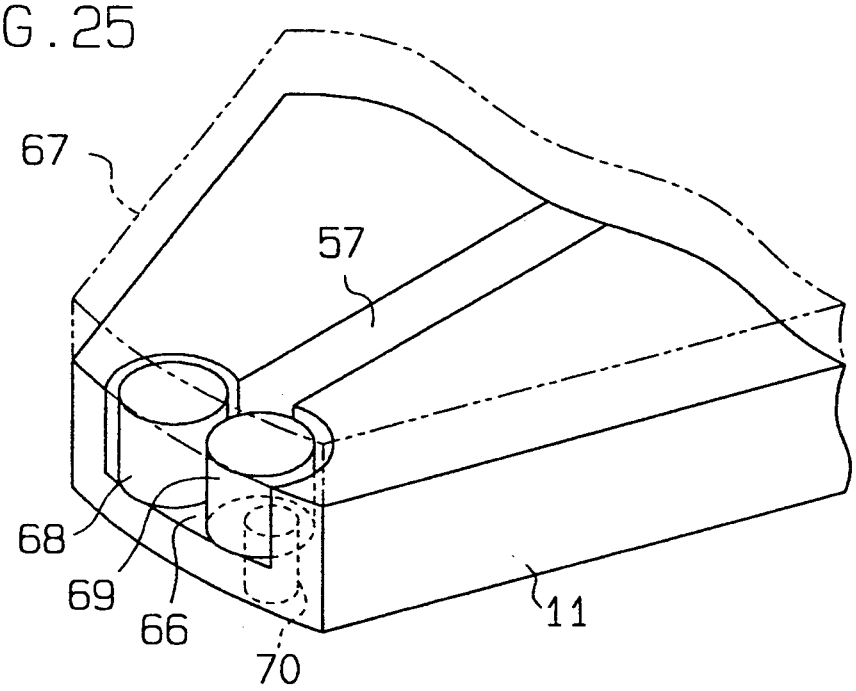
FIG. 25 is a perspective view showing the rotary assembly from the opening side of the rotor.
Figure 26:
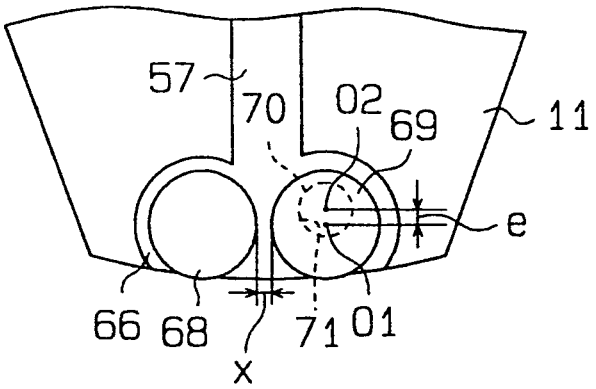
FIG. 26 is a diagram with a cover plate removed, showing the states of the contact members when no spinning is effected.
Figure 27:
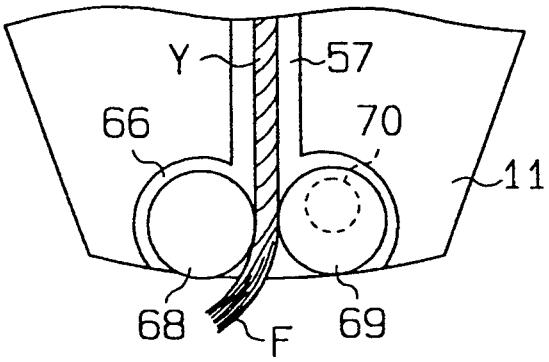
FIG. 27 is a diagram with a cover plate removed, showing the states of the contact members when spinning is effected.

An eighth embodiment will now be described referring to FIGS. 21 through 27. This embodiment differs from the individual previously-described embodiments in the structure of the twist propagation preventing portion. As shown in FIGS. 25 to 27, a retaining recess 66 open to the housing 38 and fiber-collecting section *7a* is formed at the distal end of the rotary assembly 11 at the position corresponding to the inlet of the yarn passage 57. The housing (38) side of the retaining recess 66 is covered with a cover plate 67. The recess 66 is formed to extend on both sides of the yarn passage 57, with a pair of columnar contact members 68 and 69 provided in the recess 66, sandwiching the yarn passage 57. Both contact members 68 and 69 constitute the twist propagation preventing portion. The first contact member 68 is fixed unmovable to the rotary assembly 11. On the second contact member 69 is protrusively formed a pin 70 eccentric to the center O1. The pin 70 is rotatably inserted in a support hole 71 formed in the rotary assembly 11. The center O1 of the second contact member 69 is eccentric to the center O2 of the pin 70 by a distance e. The position of the pin 70 is set in such a way that, with the center O1 of the second contact member 69, the center O2 of the pin 70 and the rotational center of the rotary assembly 11 arranged on a straight line, the gap x between both contact members 68 and 69 is narrower than the thickness of the fiber bundle at the inlet portion.

The action of the thus constituted spinning unit will be described. The rotary assembly 11 rotates at a speed slightly slower than the speed of separating the fiber bundle F from the fiber-collecting section *7a* (at a slightly faster speed than the rotational speed of the rotor 7). The suction airstream toward the yarn passage 57 generated based on the negative pressure smoothly separates the fiber bundle F from the fiber-collecting section *7a* and guides it into the yarn passage 57. The fiber bundle F moves inside the yarn passage 57 while contacting both contact members 68 and 69 provided at the inlet portion of the yarn passage 57. At the spinning time at which the fiber bundle exist between the contact members 68 and 69, the second contact member 69 is in such a position that the center O1 of the second contact member 69, the center O2 of the pin 70 and the rotational center of the rotary assembly 11 are not arranged on a straight line. Consequently, the centrifugal force that acts on the second contact member 69 with the rotation of the rotary assembly 11 urges the second contact member 69 to rotate in the direction to arrange the center O1 of the second contact member 69, the center O2 of the pin 70 and the rotational center of the rotary assembly 11 on a straight line (i.e., clockwise in FIG. 27). In other words, during the spinning, the force to push the fiber bundle F toward the first contact member 68 always acts on the second contact member 69.

Therefore, the fiber bundle F moving in the yarn passage 57 has its both ends pressed against the contact members 68 and 69 at the position corresponding thereto. This suppresses the rotation of the fiber bundle F at that position, so that the rotation of the yarn and fiber bundle, which are drawn out while being twisted, is prevented from being transmitted to the fiber bundle F located upstream of the position corresponding to both contact members 68 and 69. That is, the twist is stopped at the position corresponding to the both contact members 68 and 69. The fibers are twisted stretched as in the previous embodiments, yielding well-tightened yarn.

As the second contact member 69 is rotatable around the pin 70, even if the thickness of the fiber bundle F varies slightly, the contact member 69 is rotated around the pin 70 in a direction to widen the gap x between itself and the first contact member 68.

Figure 23:
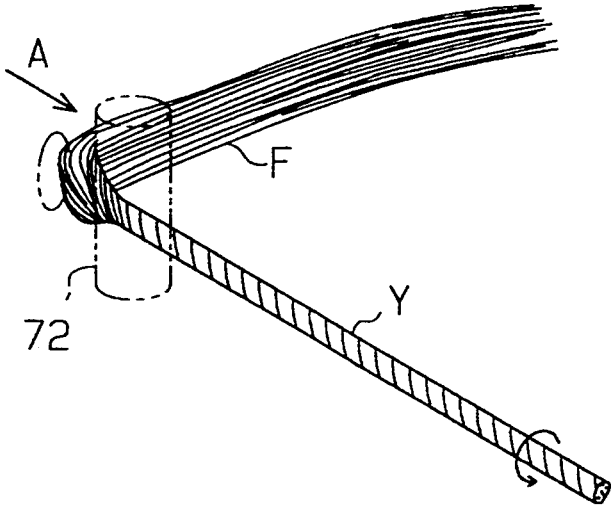
FIG. 23 is an exemplary diagram illustrating the twisting stopping action when one side of a fiber bundle is pressed against a contact member.
Figure 24:
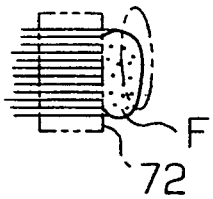
FIG. 24 is a diagram as viewed in the direction of the arrow A in FIG. 23.

As the twist propagation preventing portion provided at the inlet portion of the yarn passage 57, a twist stopping member 72 that contacts the fiber bundle F from its one side may be provided as shown in FIG. 23. In this case, those of the fibers that constitute the fiber bundle F which are encircled by the alternate long and two short dashes line in FIGS. 23 and 24, i.e., those fibers which are located on the side opposite to the side that contacts the twist stop member 72, can freely move. As a result, the fibers at that portion is freely rotatable in the rotational direction of the yarn, providing an insufficient twist-stopping effect. Accordingly, there exist fibers that softly entwine around the outer layer of the yarn, making the tightening of the yarn softer. In this embodiment, on the contrary, twisting is stopped with both sides of the fiber bundle F pressed by a pair of contact members 68 and 69, providing effective twist-stopping and thus yielding well-tightened yarn.

A pin may be protrusively provided on the first contact member 68 at an eccentric position, so that the contact member 68 is securely fitted to the rotary assembly 11 via the pin. This pin, unlike the aforementioned pin 70, is firmly fitted in the rotary assembly 11 so that the pin will not rotate by the centrifugal force which acts on the first contact member 68 when the rotary assembly 11 rotates. In this case, it is possible to arbitrarily and easily adjust the gap x formed when the second contact member 69 comes to the position to set the center O1, center O2 and the rotational center of the rotary assembly 11 on a straight line. It is therefore easy to adjust the gap x to the optimal value for the thickness of the fiber bundle F which varies due to alteration in the spinning conditions.

Ninth Embodiment

A ninth embodiment will now be described referring to FIGS. 28 through 31. This embodiment differs significantly from the individual previously-described embodiments in that a resisting member which contacts the surface of the fiber bundle F without interfering with the rotation of the fiber bundle F is provided between the actual twisting point (twisting start point) of the yarn drawing passage 47 and the twist propagation preventing portion.

Figure 28:
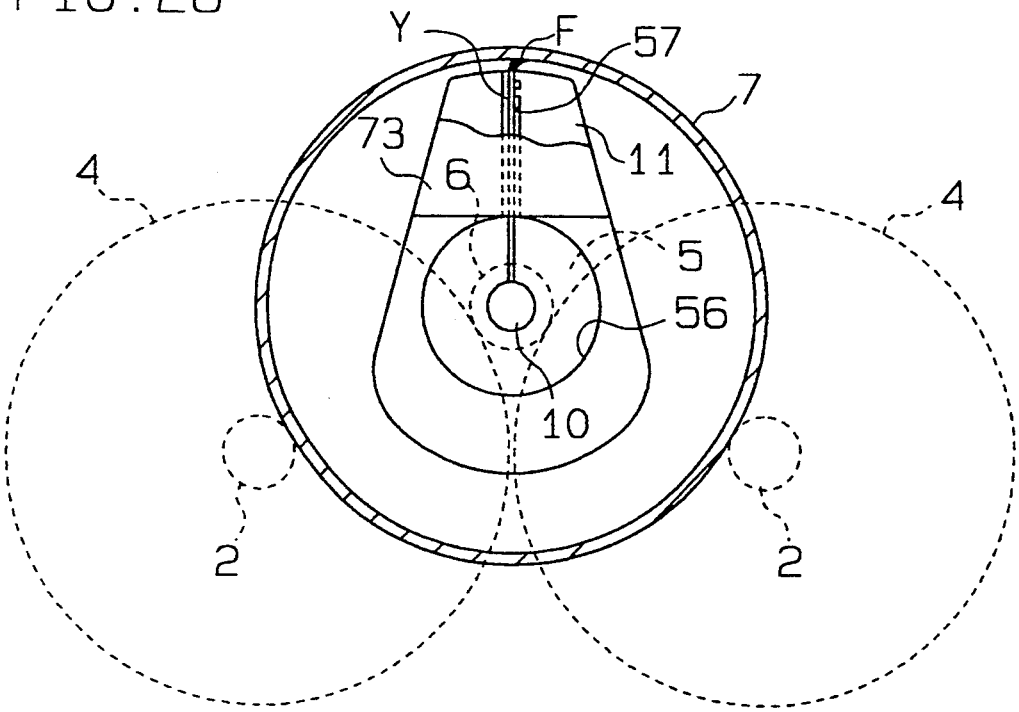
FIG. 28 is a partial cross section illustrating the relation between the rotor and rotary assembly, and a support disk and a rotor shaft as viewed from the opening side of the rotor according to the eighth embodiment.
Figure 29:
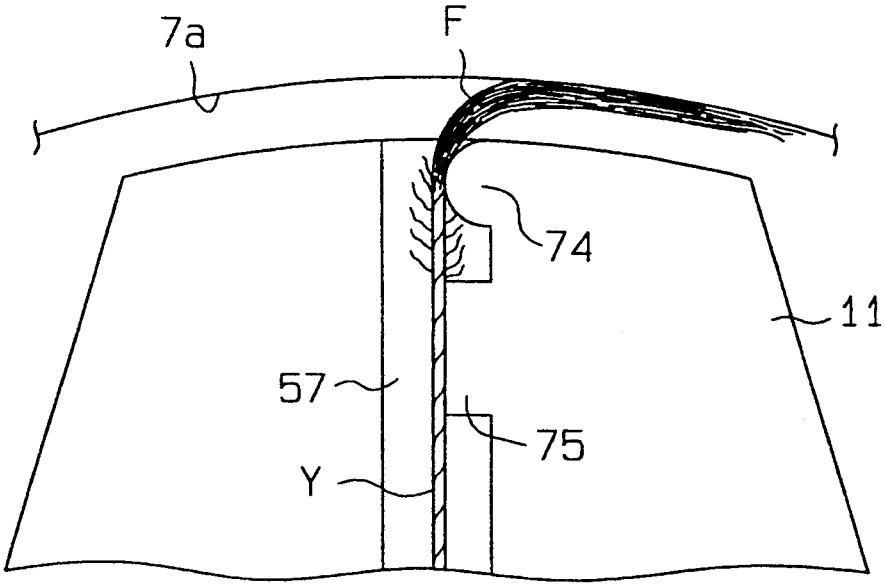
FIG. 29 is a partly enlarged view with a cover removed, showing the rotary assembly from the opening side of the rotor.
Figure 30:
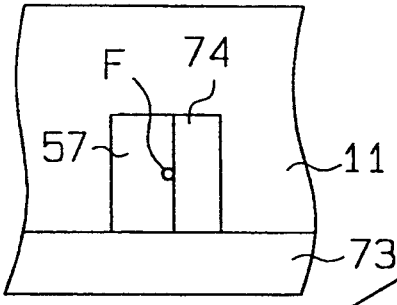
FIG. 30 is a partly enlarged view showing the rotary assembly from the inlet side of a yarn passage.

As shown in FIG. 28, a cover plate 73 for exposing the yarn passage 57 is secured to the distal end of the rotary assembly 11 on the side of the housing 38. As shown in FIG. 29, a semi-columnar twist propagation preventing portion 74 is protrusively formed on that wall of the inlet-side end of the yarn passage 57 which lies on the rotational direction side of the rotary assembly 11. The twist propagation preventing portion 74 is designed such that as the fiber bundle F is pressed against the twist propagation preventing portion 74 by the force to put the fiber bundle F into the yarn passage 57, the twist of the fiber bundle F is prevented from propagating toward the upstream from that position. Because the longer the length of contact between the fiber bundle F and twist propagation preventing portion 74 is, the greater the twist stopping effect is, it is preferable that the radius of the twist propagation preventing portion is 0.5 mm or more.

Figure 32:
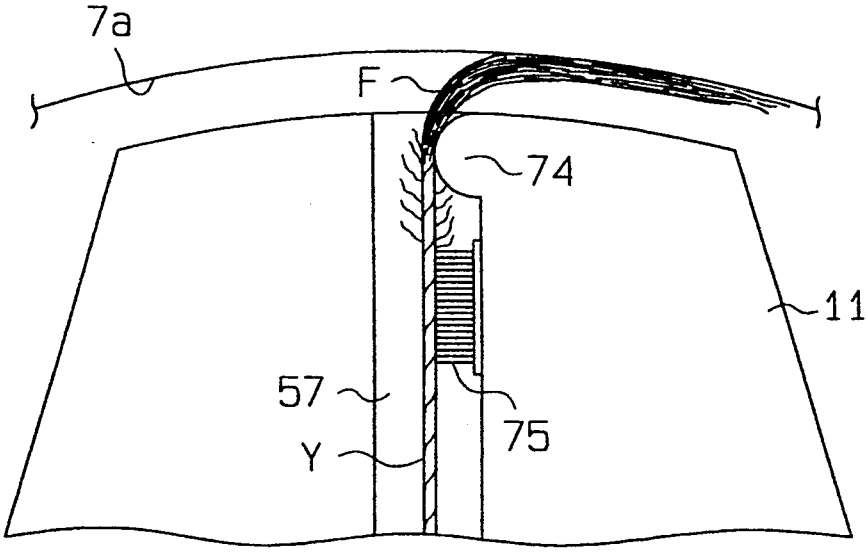
FIG. 32 is a partly enlarged view showing a resisting member according to a modification.

The yarn passage 57 is provided with a resisting member 75 at the downstream of the twist propagation preventing portion 74. The resisting member 75 contacts the surface of the fiber bundle F without interfering with the rotation of the fiber bundle (yarn) F which is guided into the yarn drawing passage 47 while being pressed against the twist propagation preventing portion 74. The resisting member 75 is formed to protrude over part of the wall of the yarn passage 57 in parallel to the yarn passage 57. As shown in FIG. 32, a brush may be provided as the resisting member 75.

At the time the spinning is effected, the rotary assembly 11 rotates at a speed slightly slower than the speed of separating the fiber bundle F from the fiber-collecting section *7a* (at a slightly faster speed than the rotational speed of the rotor 7). The fiber bundle F collected at the fiber-collecting section *7a* is smoothly separated therefrom and is guided into the yarn passage 57. When guided into the yarn passage 57, the fiber bundle F is applied with tension and is thus pressed against the twist propagation preventing portion at the inlet of the yarn passage 57. This suppresses the rotation of the fiber bundle F at that position, thus repressing the transmission of the rotation of the yarn and fiber bundle, which are drawn while being twisted, toward the fiber bundle F located upstream of the position corresponding to the twist propagation preventing portion 74. In other words, twisting is stopped at the position corresponding to the twist propagation preventing portion 74. Thus, tension is applied to the fibers when the fiber bundle F is twisted, so that the fibers are twisted while being stretched.

Not all the fibers constituting the fiber bundle F are restricted to rotate at both ends while the fiber bundle F is twisted. Accordingly, part of the outer-layer fibers of the fiber bundle F that has passed the twist propagation preventing portion 74 stands upward from the surface of the fiber bundle F as nap fa. When the fiber bundle F having nap fa on its surface passes the position corresponding to the resisting member 75, the surface of the fiber bundle F slides on the resisting member 75 with a strength that does not interfere with the rotation of the fiber bundle F.

Figure 31:
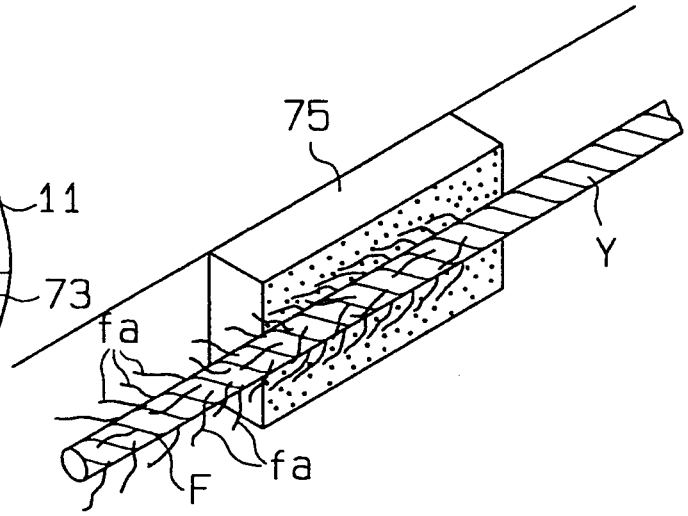
FIG. 31 is an exemplary diagram showing the action.

That is, the fiber bundle F turns (rotates) by the twisting force while part of the outer layer fibers and the surface nap fa are in contact with the resisting member 75. Consequently, the surface nap fa entwines the fiber bundle in a spiral form, as shown in FIG. 31. The fibers coiled softly on the surface portion are therefore entwined firmly to tighten the inner fibers. As the outer layer of fibers and the nap entwine around the fiber bundle F, the yarn is tightened so that a cloth made of this yarn will have good texture.

Figure 33:
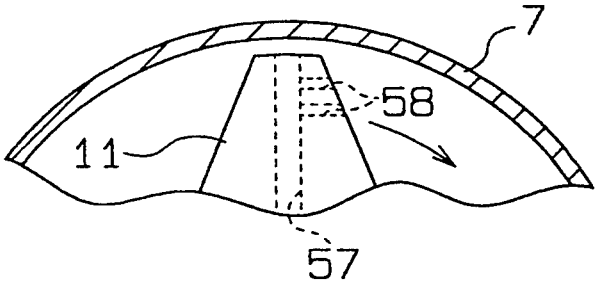
FIG. 33 is a partly enlarged view showing a twist propagation preventing portion according to another modification.
Figure 34:
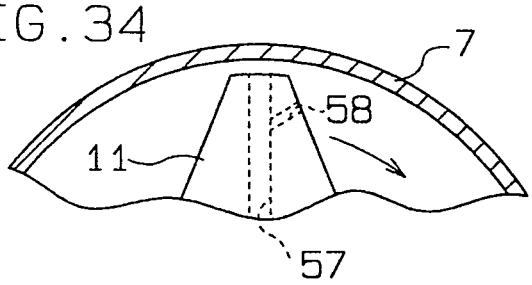
FIG. 34 is a partly enlarged view showing the twist propagation preventing portion according to the modification.

The present invention is not limited to the above-described embodiments. For instance, the position of the hole 58 constituting the twist propagation preventing portion in the first embodiment may be changed as follows. Instead of forming the hole 58 to be open to the housing 38, the hole 58 may be formed so that its one end is open to the rotational-direction side of the rotary assembly 11, as shown in FIGS. 33 and 34. In this case, the twisting of the fiber bundle is stopped by airstream forced into the yarn passage 57 from the hole 58 with the rotation of the rotary assembly 11 without providing negative pressure in the yarn passage 57 by the action of the ejector. When negative pressure is provided in the yarn passage 57 by the action of the ejector, however, the twist-stopping performance of the airstream is improved.

Further, many stripes extending in the moving direction of the fiber bundle F may be formed on the wall of the recess 61 in the fourth embodiment. Furthermore, the projection 62 in the fifth embodiment may be modified to be a number of stripe projections formed on the wall of the recess to extend in the moving direction of the fiber bundle F.

In addition, the projections **63*a* and recesses 63*b* may be formed spiral in the sixth embodiment. The projections 63*a* and recesses 63*b* formed at the inlet portion of the yarn passage 57 may be formed only on that side which corresponds to the portion where the fiber bundle F passes, instead of forming them all over the shaft 63**.

Figure 35:
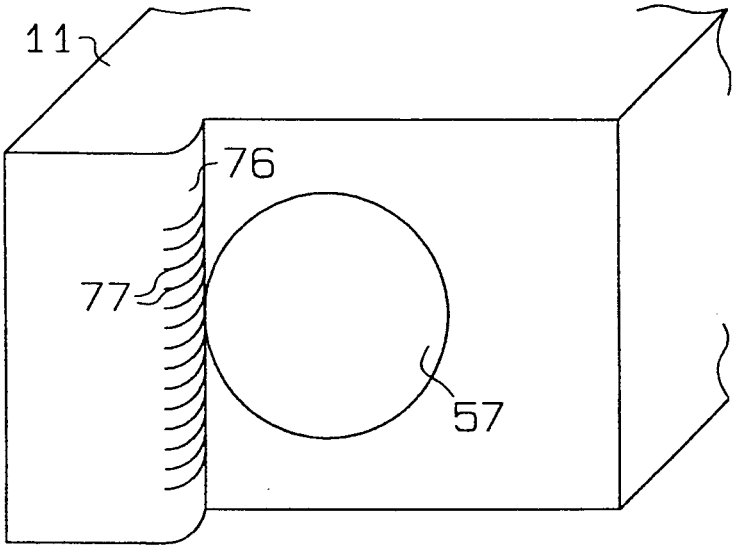
FIG. 35 is a partly enlarged view showing the twist propagation preventing portion according to another modification.
Figure 38:
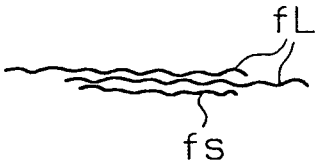
FIG. 38 (PRIOR ART)
FIGS. 38 and 39 are exemplary diagram showing a shorter fiber being bent when a fiber bundle is drafted.
Figure 39:
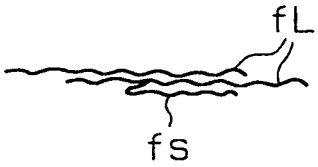
FIG. 39 (PRIOR ART)
Figure 36:
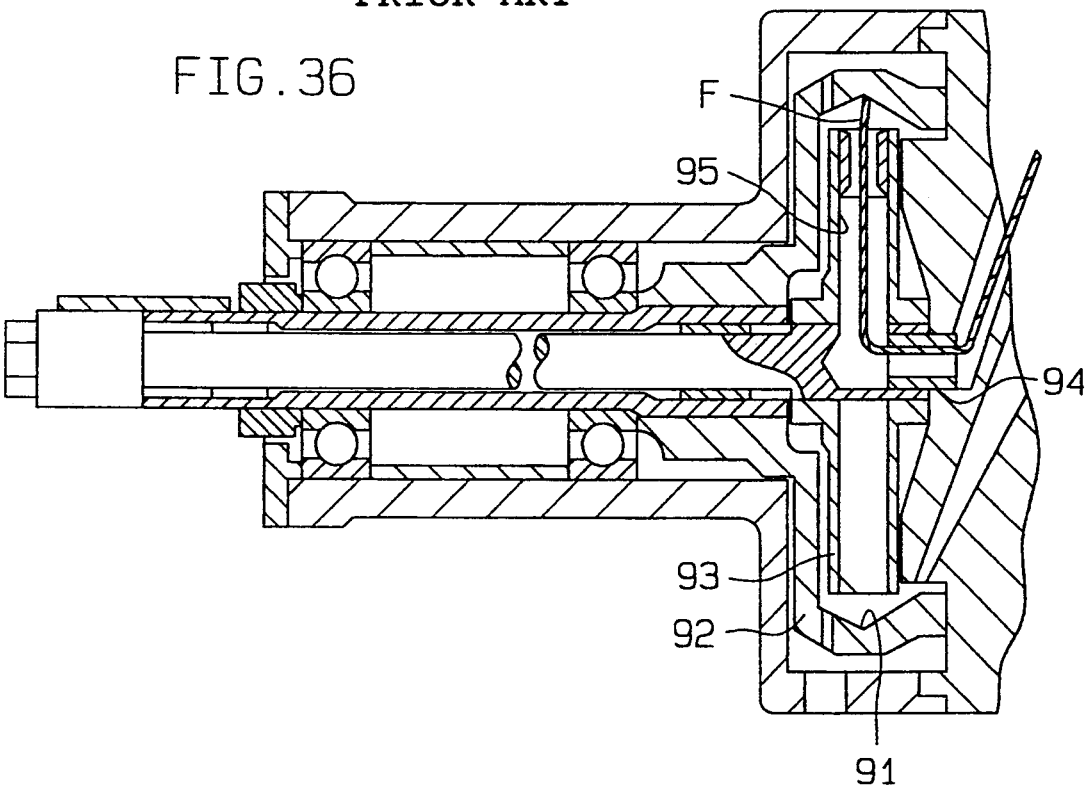
PRIOR ART FIG. 36
FIG. 36 is a vertical cross-sectional view of a conventional apparatus.
Figure 37:
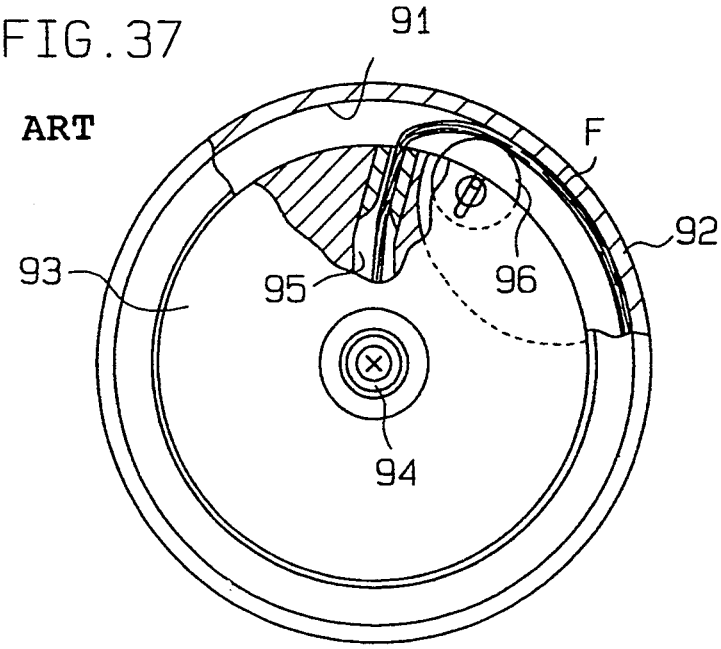
FIG. 37 PRIOR ART
FIG. 37 is a partly cutaway front view illustrating the relation between an outer rotor and a draft rotor as viewed from the opening side of the outer rotor of the conventional apparatus.
Figure 40:
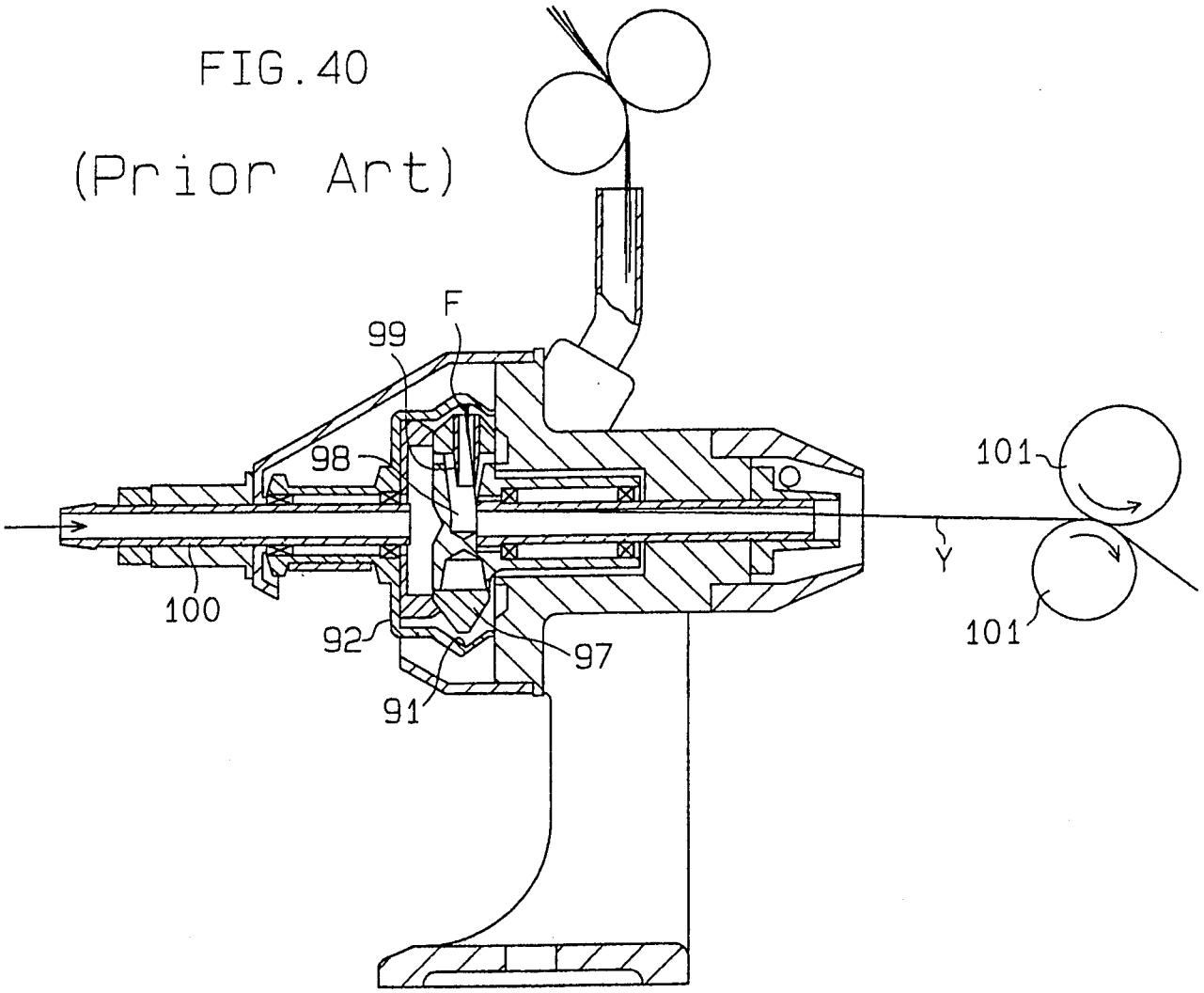
FIG. 40 (Prior Art)
FIG. 40 is a vertical cross-sectional view of another conventional apparatus.

As shown in FIG. 35, an arc surface 76 may be provided at the corner of the inlet portion of the yarn passage 57 on the side of the separating-point moving direction of the fiber bundle F, with many stripes 77 formed on the arc surface 76 to extend in the moving direction of the fiber bundle F. Each stripe 77 may not run continuously between both ends of the arc surface 76, but can be cut in the midway.

A mechanical seal or labyrinth seal may be provided between the boss portion 39 and the rotary assembly 11, or the ejector as the negative pressure generating device may be replaced with another suction means connected to the yarn pipe. Further, the negative pressure generating device may be omitted.

What is claimed is:

1. A rotor type open-end spinning unit comprising:

a rotor with an open side and having a fiber-collecting section for collecting opened fibers supplied thereto;

a yarn drawing passage provided in communication with said open side of said rotor and having a first end portion that is located coaxial with said rotor;

a rotary assembly, provided in said rotor coaxially therewith, said rotary assembly including means for active driving thereof separate from said rotor, said rotary assembly having at least a first part facing toward and proximate to said fiber-collecting section and a second part facing toward said first end portion of said yarn drawing passage in proximity thereto;

a yarn passage, formed in said rotary assembly extending from said first to said second part of said rotary assembly, for guiding a fiber bundle from said fiber-collecting section to a position opposite said first end portion of said yarn drawing passage; and twist propagation preventing means extending into the end of said yarn passage which is located in said first part of said rotary assembly.

2. The rotor type open-end spinning unit according to claim 1, wherein said rotary assembly is provided with fiber-entwining preventing means at an upstream of said twist propagation preventing means and closer to said fiber-collecting section, at a position opposite to a separating-point moving direction of that fiber bundle which is being separated from said fiber-collecting section.

3. The rotor type open-end spinning unit according to claim 2, wherein said twist propagation preventing means is a wedge-shaped recess provided at a corner of said inlet portion of said yarn passage on that side of a separating-point moving direction of said fiber bundle.

4. The rotor type open-end spinning unit according to claim 2, wherein said twist propagation preventing means is a projection and a recess smaller than a diameter of a fiber bundle and larger than a diameter of fibers, and provided at a corner of said inlet portion of said yarn passage on that side of a separating-point moving direction of said fiber bundle so as to extend in a direction of drawing said fiber bundle.

5. The rotor type open-end spinning unit according to claim 1, wherein a yarn-surface resisting member which contacts a surface of said fiber bundle without interfering with the rotation of said fiber bundle is provided between an actual twisting point of said yarn drawing passage and said twist propagation preventing means.

6. The rotor type open-end spinning unit according to claim 5, wherein said twist propagation preventing means is a wedge-shaped recess provided at a corner of said inlet portion of said yarn passage on that side of a separating-point moving direction of said fiber bundle.

7. The rotor type open-end spinning unit according to claim 5, wherein said twist propagation preventing means is a projection and a recess smaller than a diameter of a fiber bundle and larger than a diameter of fibers, and provided at a corner of said inlet portion of said yarn passage on that side of a separating-point moving direction of said fiber bundle so as to extend in a direction of drawing said fiber bundle.

8. The rotor type open-end spinning unit according to claim 1, wherein a negative pressure generating device is provided in said yarn drawing passage located closer to the downstream end of said yarn drawing passage than to said first end portion of said yarn drawing passage.

9. The rotor type open-end spinning unit according to claim 1, wherein said twist propagation preventing means is a wedge-shaped recess provided at a corner of said inlet portion of said yarn passage on that side of a separating-point moving direction of said fiber bundle.

10. The rotor type open-end spinning unit according to claim 1, wherein said twist propagation preventing means includes a projection and a recess, the recess being smaller than the diameter of the fiber bundle and larger than the diameter of individual fibers and provided at a corner of an inlet portion of said yarn passage on that side of a separating-point of said fiber bundle with said recess extending in the direction of drawing said fiber bundle.

11. The rotor type open-end spinning unit according to claim 1, wherein said twist propagation preventing means has a pair of contact members that contact a fiber bundle from both sides thereof.

12. A rotor driving method for a rotor type open-end spinning unit in which opened fibers are supplied into the open side of a rotor rotating at high speed, and a fiber bundle is collected at a fiber-collecting section of the rotor and drawn through a yarn drawing passage provided on said open side of the rotor, the method comprising the steps of:

providing a rotary assembly in said rotor coaxial therewith, said rotary assembly being actively driven separately from said rotor, said rotary assembly having at least a first part facing toward and proximate to said fiber-collecting section and a second part facing toward said yarn drawing passage;

forming a yarn passage in said rotary assembly to guide said fiber bundle to a position opposite said yarn drawing passage from the vicinity of said fiber-collecting section;

providing twist propagation preventing means in that end of said yarn passage which is proximate to said fiber-collecting section; and driving said rotor and said rotary assembly in such a way that the relation expressed by the following equation is satisfied:

$$\pi DR_1+0.8V \leqq \pi DR_2 \leqq \pi DR_1+V$$

where D is the diameter of said fiber-collecting section, $R_1$ is the number of rotations of said rotor in a given time interval, $R_2$ is the number of rotations of said rotary assembly in said given time interval, and V is the yarn drawing speed.

13. The rotor driving method according to claim 12, wherein said rotary assembly is provided with fiber-entwining preventing means at an upstream of said twist propagation preventing means and closer to said fiber-collecting section, at a position opposite to a separating-point moving direction of that fiber bundle which is being separated from said fiber-collecting section.

14. The rotor driving method according to claim 12, wherein a yarn-surface resisting member which contacts a surface of said fiber bundle without interfering with the rotation of said fiber bundle is provided between an actual twisting point of said yarn drawing passage and said twist propagation preventing means.

15. The rotor driving method according to claim 12, wherein said twist propagation preventing means has a pair of contact members that contact a fiber bundle from both sides thereof.

16. The rotor driving method according to claim 12, wherein a negative pressure generating device is provided in said yarn drawing passage closer to the downstream end of said yarn drawing passage than to the upstream end of said yarn drawing passage.

* * * * *